US005676564A

United States Patent [19]

Kobayashi et al.

[11] Patent Number: 5,676,564

[45] Date of Patent: Oct. 14, 1997

[54] JOINT CONNECTOR, TEMPORARY HOLDING JIG FOR USE THEREWITH, AND METHOD OF MAKING WIRE HARNESSES

[75] Inventors: Takashi Kobayashi; Masayoshi Imoto, both of Yokkaichi, Japan

[73] Assignee: Sumitomo Wiring Systems, Ltd., Japan

[21] Appl. No.: 516,011

[22] Filed: Aug. 16, 1995

[30] Foreign Application Priority Data

Aug. 31, 1994 [JP] Japan ..... 6-207285

[51] Int. Cl.[6] ..... H01R 31/08

[52] U.S. Cl. ..... 439/509

[58] Field of Search ..... 439/721, 723, 439/724, 713, 189, 752, 596, 509, 511

[56] References Cited

U.S. PATENT DOCUMENTS

| | | | |
|---|---|---|---|
| 4,319,799 | 3/1982 | Pearce, Jr. | 439/752 X |
| 4,750,893 | 6/1988 | Sueyoshi et al. | 439/596 OR |
| 5,041,017 | 8/1991 | Nakazato et al. | 439/509 OR |
| 5,326,287 | 7/1994 | Hamakita et al. | 439/752 OR |

FOREIGN PATENT DOCUMENTS 21107 5/1990 Japan .

*Primary Examiner*—P. Austin Bradley
*Assistant Examiner*—Daniel Wittels
*Attorney, Agent, or Firm*—Jordan B. Bierman; Bierman, Muserlian and Lucas LLP

[57] ABSTRACT

A joint connector for holding and electrically connecting a plurality of terminals comprising a housing containing a plurality of terminal chambers parallel to and adjacent one another, thereby forming a row of said terminal chambers, each of the terminal chambers adapted to receive one of the terminals introduced in a downstream direction, at least one cover plate hingedly mounted on the housing and constituting a side thereof, the cover plate being rotatable between an open position, wherein the cover plate is away from the housing thereby exposing the terminal chambers, and a closed position, wherein the cover plate is adjacent the housing and the terminal chambers are enclosed, at least one electrically conductive clip having at least two contacts which are electrically connected to each other by an intermediate area, each of the contacts extending into one of the terminal chambers, whereby two of the terminals, in the terminal chambers, make electrical connections with the contacts.

12 Claims, 22 Drawing Sheets

JOINT CONNECTOR, TEMPORARY HOLDING JIG FOR USE THEREWITH, AND METHOD OF MAKING WIRE HARNESSES

This Application claims the benefit of the priority of Japanese Application 6-207285, filed Aug. 31, 1994.

The present Invention is directed to a joint connector, intended for use with a temporary holding jig, and a method of making wire harnesses using the connector and the jig. Temporary binding circuits are formed in advance, and then combined to form the completed circuit. The present Invention relates to the last step in the formation of the wire harness.

BACKGROUND OF THE INVENTION

In general, a wire harness is an electric wiring system containing a number of cables, often comprising as many as 400–500 circuits. When producing such large scale wire harnesses, a plurality of unit cable binding assemblies (called temporary binding circuits) is first manufactured. These are then electrically connected by various means by what is called the final binding process.

The temporary binding circuit contains last-in terminals which are fastened to the ends of a plurality of cables comprising the wire harness and are mounted onto a connector at the final binding of the temporary binding circuits or when connecting the wire harness to a desired device (the last-in process). In other words, this last-in terminal is left exposed on the end of the cable until the last-in process is carried out.

The existence of the last-in terminal creates various problems in manufacturing wire harnesses; e.g. its susceptibility to deformation during transport. Obviously, if the terminal is deformed, mounting on a connector becomes difficult, continuity of the cable may be compromised, etc. Similarly, there is a tendency of cable components fastened to the last-in terminal to become entangled with other cable components, thus making handling difficult.

Also, the last-in process is labor intensive; i.e. there are many cases wherein a plurality of last-in terminals is connected to a common connector. In such cases, cables connected to the last-in terminal which had been previously inserted prevented the last-in terminals of succeeding temporary binding circuits from being inserted. In energizing each cable of the temporary binding circuits, the terminals on the cables are inserted into a female housing in advance, and then connected to the joint connector.

Since the operation is carried out manually, a problem arises in making certain that each last-in terminal is inserted into its proper connector. Particularly in view of the large number of binding circuits which are often present, this can be a serious problem and a cause of rejection of completed harnesses. A further problem resides in testing the continuity of the individual circuits. Such tests require that the terminal be mounted on a connector in a specified position. However, before the last-in process is completed, the terminal has not yet been mounted. Therefore, carrying out the continuity test to determine the integrity of the circuit is extremely difficult.

SUMMARY OF THE INVENTION

The present Invention is intended to solve the foregoing problems. More specifically, it provides a practical means to handle the last-in terminal on a temporary binding circuit and comprises a manufacturing method which eliminates the need for a terminal housing to be connected to the joint connector. The Invention also includes a joint connector for use with a temporary holding jig and related method.

The Invention is particularly applicable to the manufacture of wire harnesses which are made up of a plurality of binding circuits, each of which comprises last-in terminals mounted on the ends of a plurality of cables. The last-in terminals are divided into groups, each group, with its last-in terminal, to be connected to a specific joint connector. The terminals are temporarily retained in a holding jig after being appropriately sorted. Thereafter, the holding jig is placed adjacent the appropriate joint connector and the terminals are then transferred into the joint connector and permanently secured therein.

The Invention further comprises a joint connector which is particularly designed for receipt of the terminals in conjunction with the temporary holding jig. The joint connector comprises a main housing divided into a plurality of terminal chambers, each of which is adapted to receive one of the last-in terminals. The holding jig and the joint connector are designed so that the former, while containing the terminals temporarily therein, may be inserted into the latter. Thereafter, the terminals are ejected from the jig into the joint connector. After the jig is removed, the connector is closed to retain the terminals permanently.

There is also provided at least one clip which can connect two or more of the terminals with each other, thereby forming branch circuit(s). Furthermore, the housing carries various elements for guiding the last-in terminals through the holding jig and into contact with the clip(s).

At this point, since the various last-in terminals have been inserted into their corresponding joint connectors, it is easy to carry out the continuity tests for each binding circuit. The connectors are placed in contact with the various elements of the testing device and the integrity of the circuits is thereby assured.

Moreover, the transfer of the terminals from the holding jig into the joint connector is carried out simply and with minimum opportunity for error. The Invention also permits branch circuits to be established by the use of clips of suitable design, depending upon the particular connections desired.

BRIEF DESCRIPTION OF THE DRAWINGS

In the accompanying drawings, constituting a part hereof and in which like reference characters indicate like parts, FIG. 1 schematically illustrates a wire harness of the type produced by the present Invention.

DESCRIPTION OF THE PREFERRED EMBODIMENT

Description follows below of a preferable embodiment of the present Invention with reference to the attached drawings.

Figure 1:
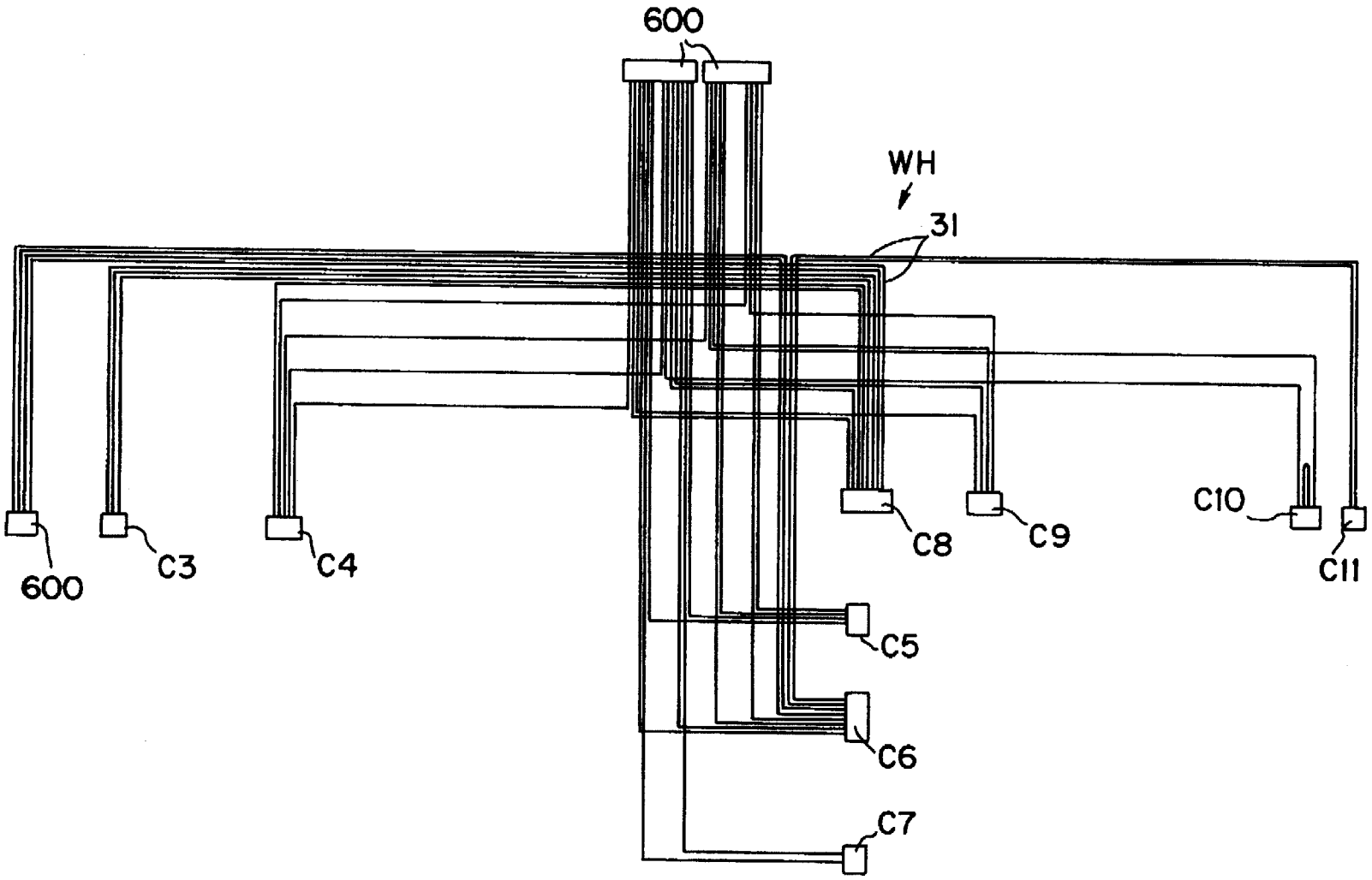
Figure 2:
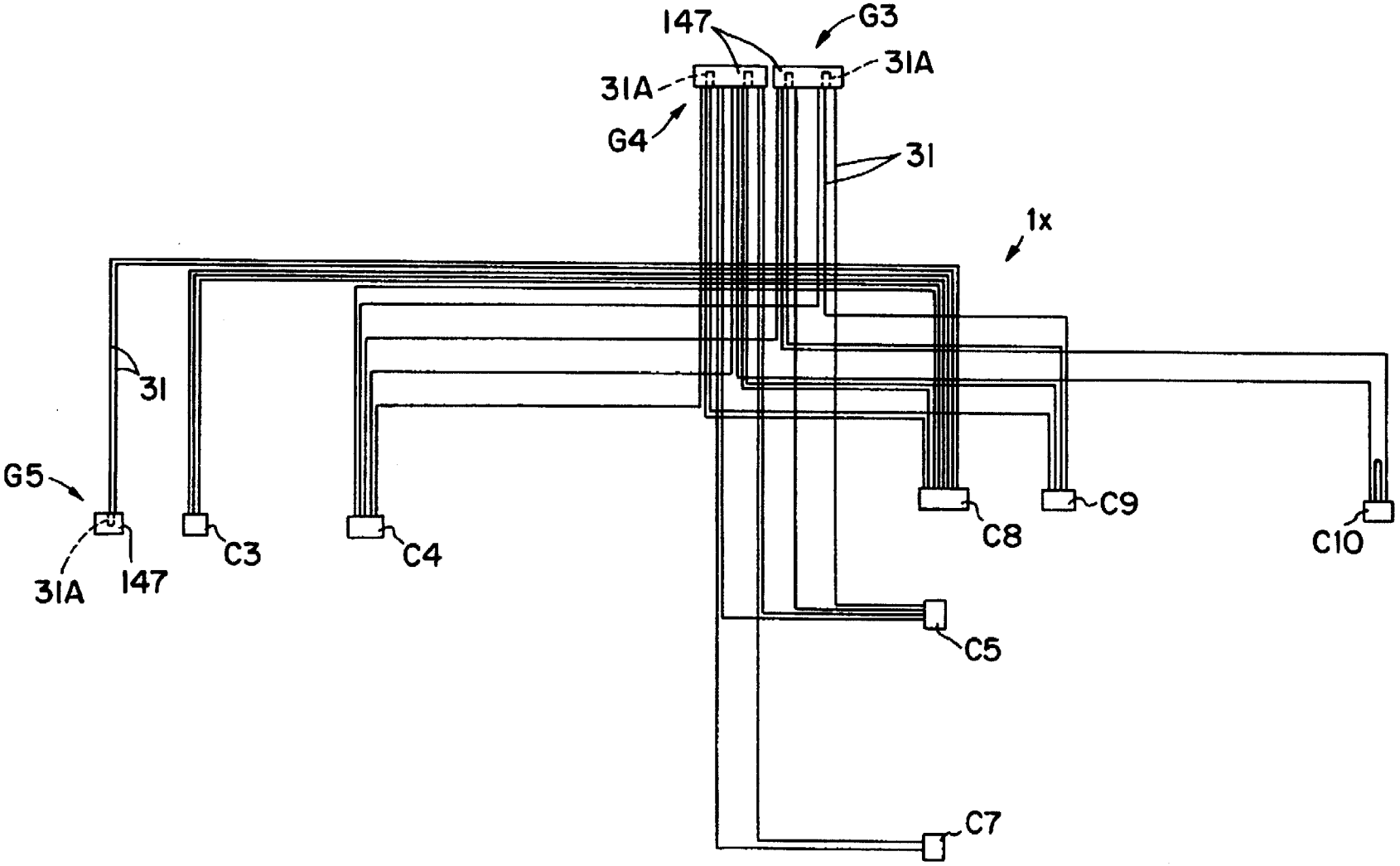
FIG. 2 schematically illustrates a first temporary binding circuit which is part of the wire harness of FIG. 1.
Figure 3:
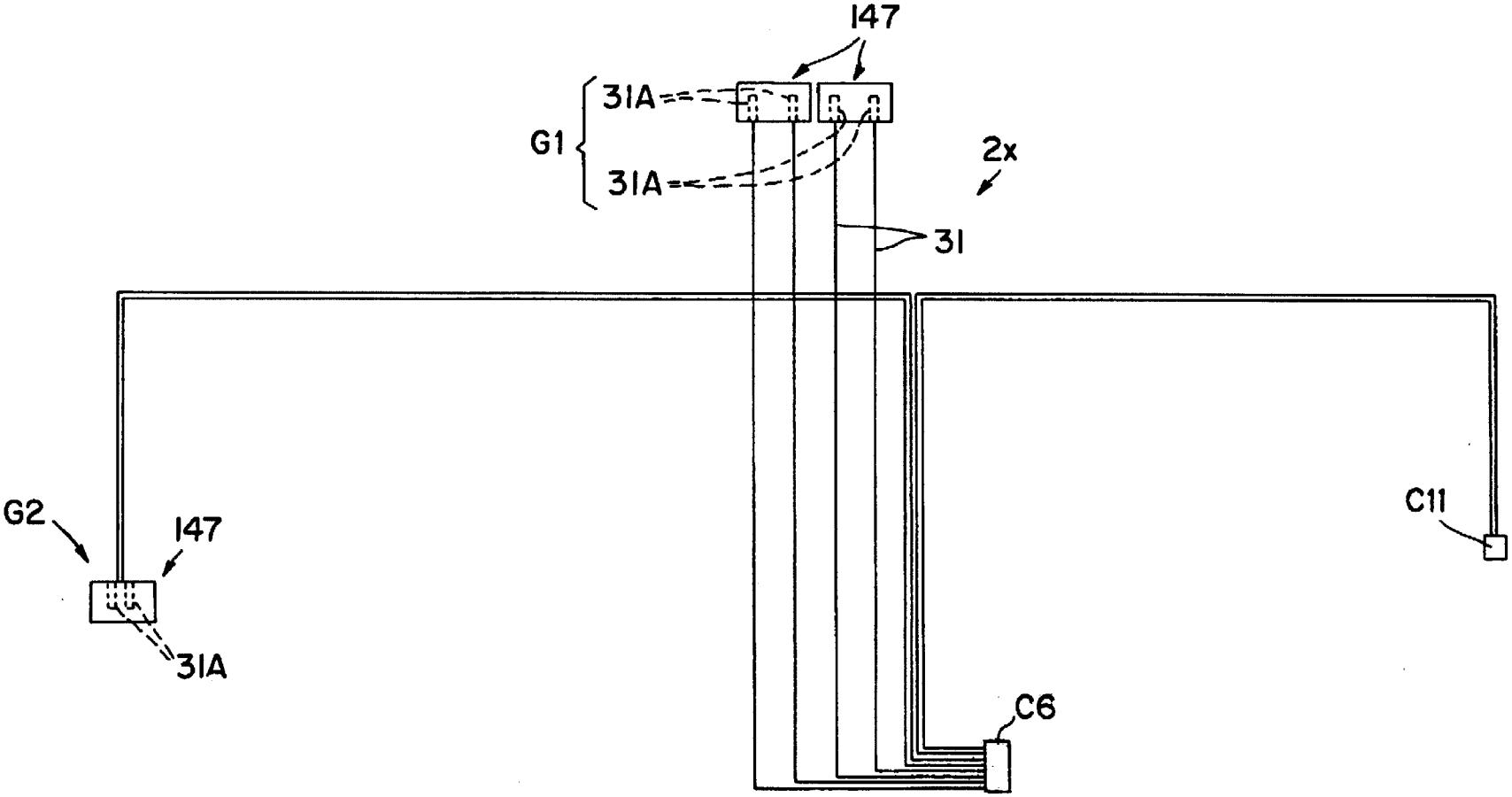
FIG. 3 schematically illustrates a second temporary binding circuit which is part of the wire harness of FIG. 1.

Temporary binding circuit 1x (as shown in FIG. 2) and temporary binding circuit 2x (as shown in FIG. 3) are premanufactured and combined to form wire harness WH (as shown in FIG. 1). Each of circuits 1x and 2x is produced by automatic wire harness manufacturing apparatus which determines the length of cables 31, strips the ends thereof, crimps process terminals 31A to the stripped cable, and inserts terminals 31A into connectors C1 to C11. Binding circuit 2x (FIG. 3) comprises group G1 of terminals 31A as the last-in terminal to be connected to connector C1 of binding circuit 1x (FIG. 2) and group G2 of terminals 31A to be connected to connector C2. Similarly, circuit 1 x comprises groups G3 to G5 to be connected as shown in FIG. 1.

In the terminal insertion process, when manufacturing binding circuit 2x, all groups G1 and G2 of last-in terminals 31A are accommodated in joint connector 600 by way of holding jig 147 as shown in FIGS. 8 to 11 and 4 to 6, respectively. By connecting each terminal 31A held by holding jig 147 with the appropriate connectors C1 and C11, both binding circuits 1x and 2x combine to form wire harness WH of FIG. 1.

Thus, by assorting terminals 31A by groups G1–G5 for every joint connector 600 to be connected to terminals 31A, temporarily holding them in a removable manner in temporary binding jig 147, the last-in terminals are aligned with their corresponding joint connectors 600 for insertion therein and electrical connection thereto; thereby both temporary binding circuits 1 x and 2 x are joined to form wire harness WH as illustrated in FIG. 1.

DETAILED DESCRIPTION OF THE INVENTION

Figure 4:
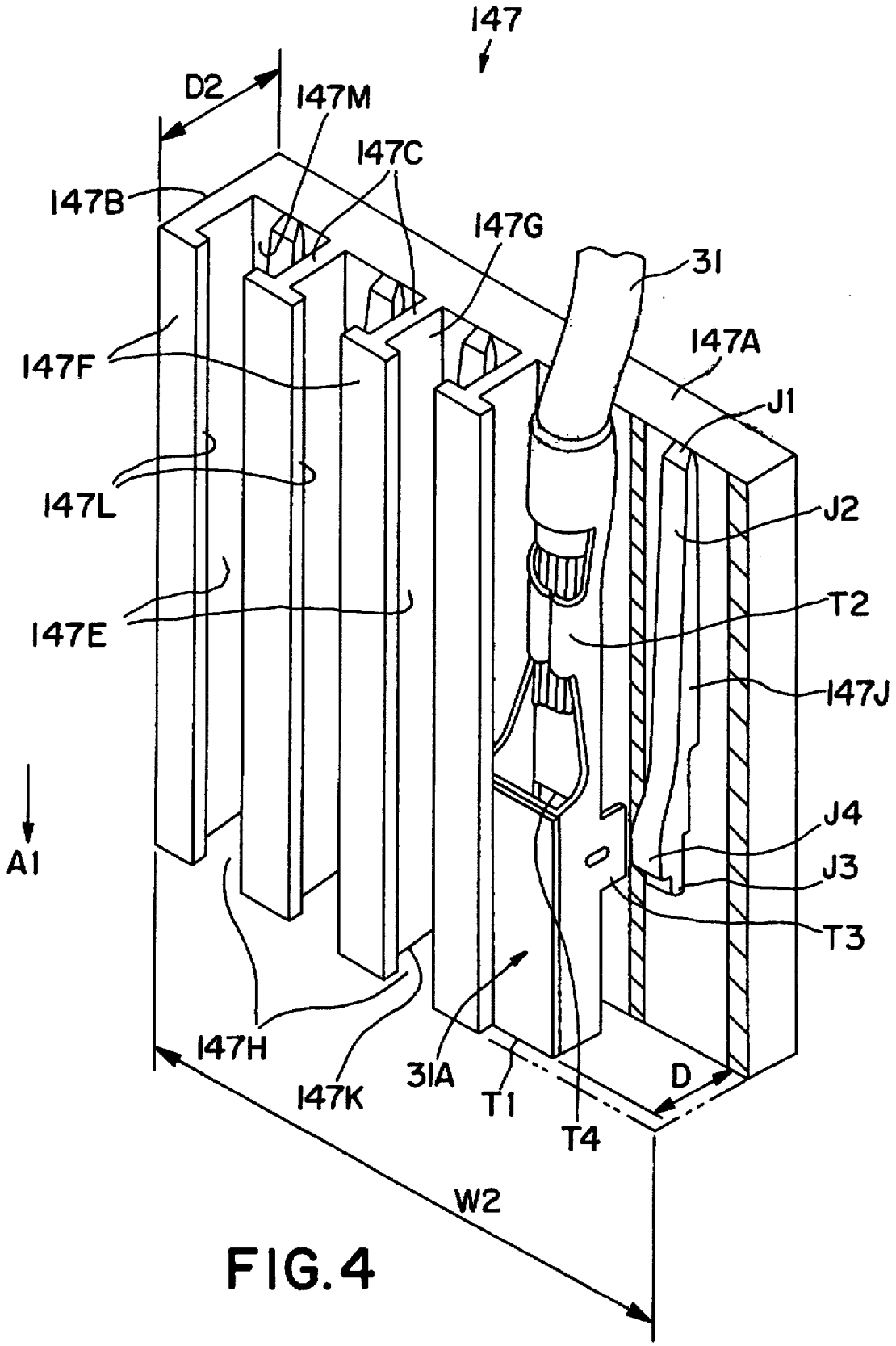
FIG. 4 is a perspective view, partially broken away, of the temporary holding jig for last-in terminals for use with the present Invention.
Figure 5:
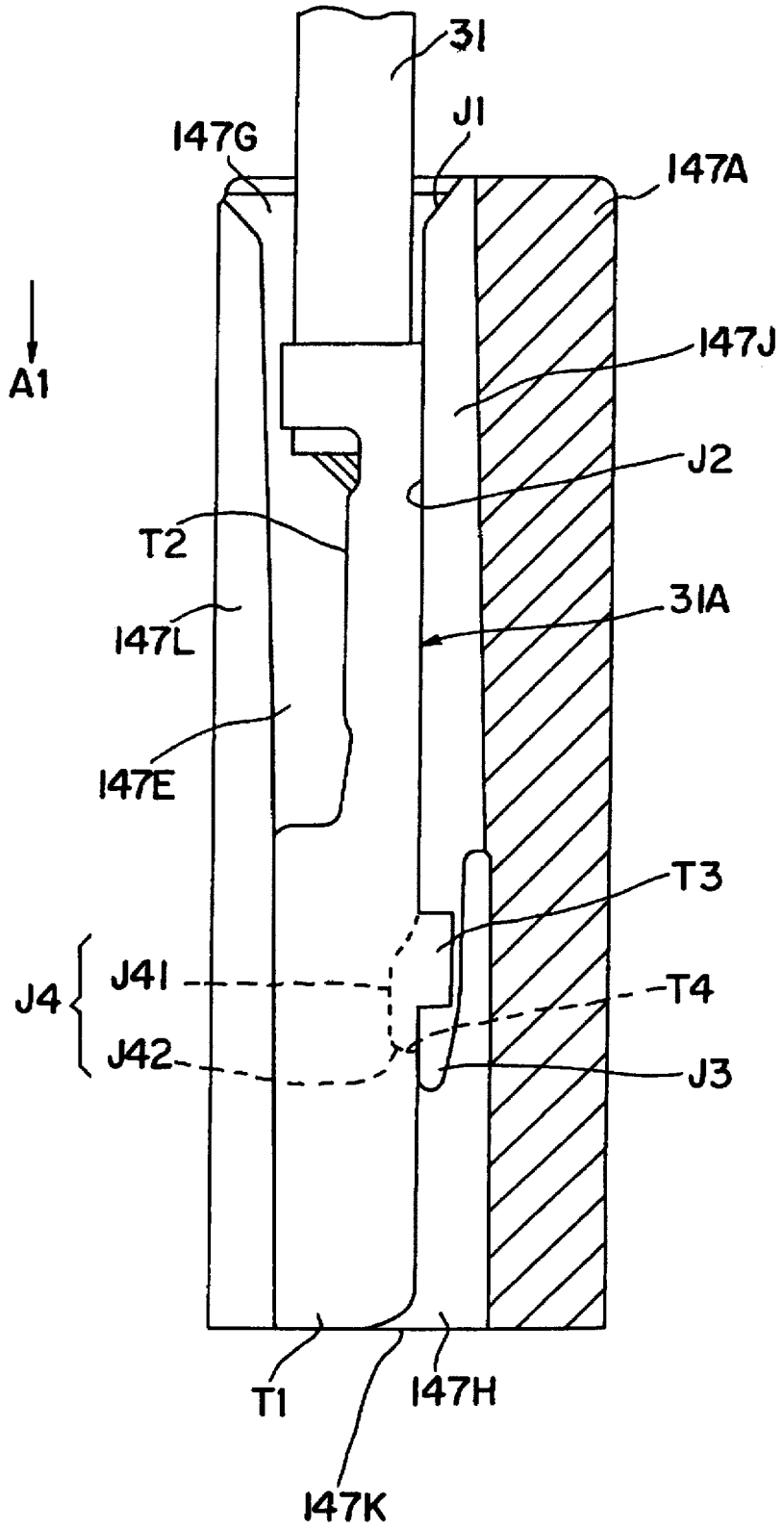
FIG. 5 is a vertical section of the temporary holding jig of FIG. 4.
Figure 6:
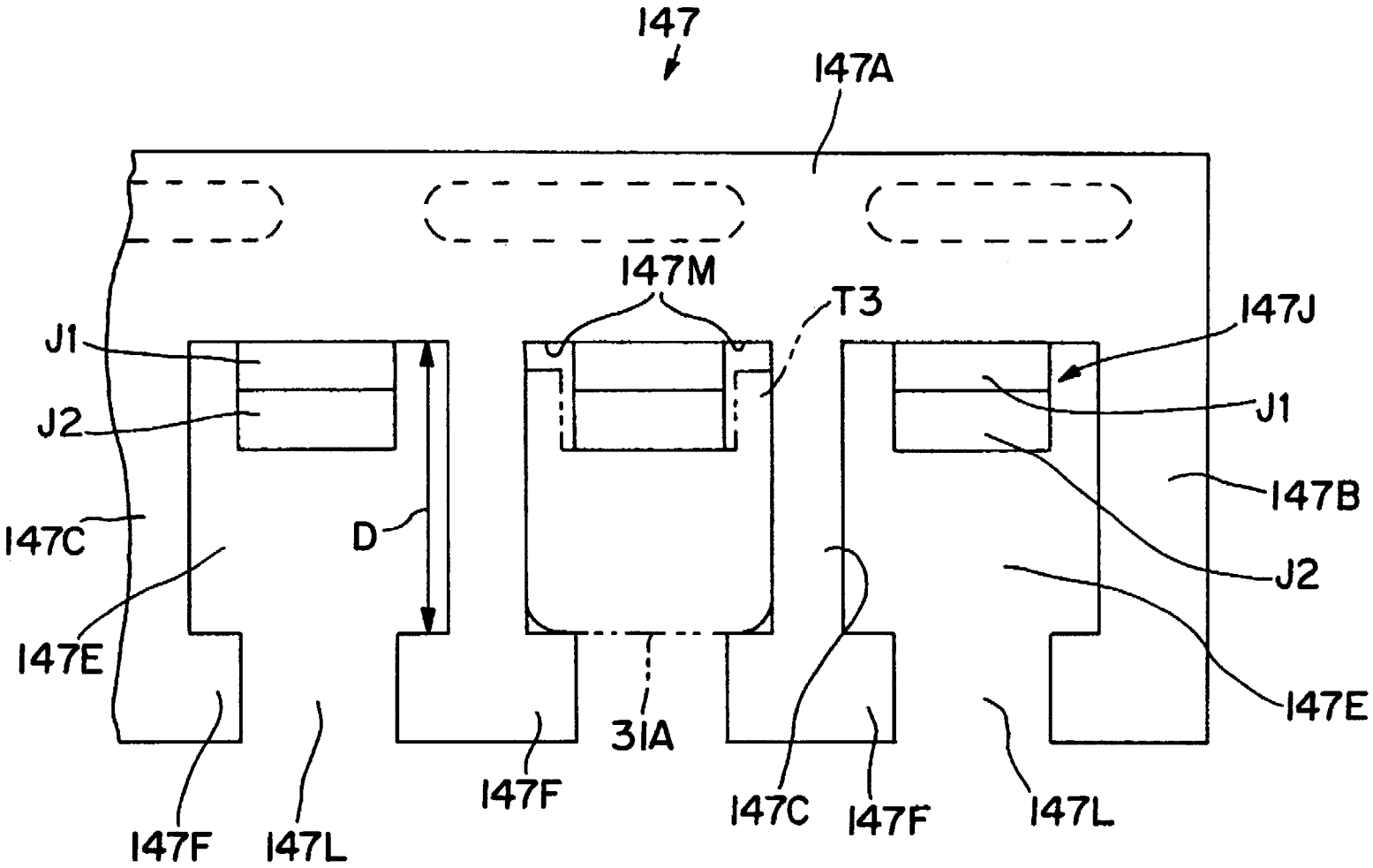
FIG. 6 is an enlarged plan view of the main portion of the temporary holding jig of FIG. 4.
Figure 7:
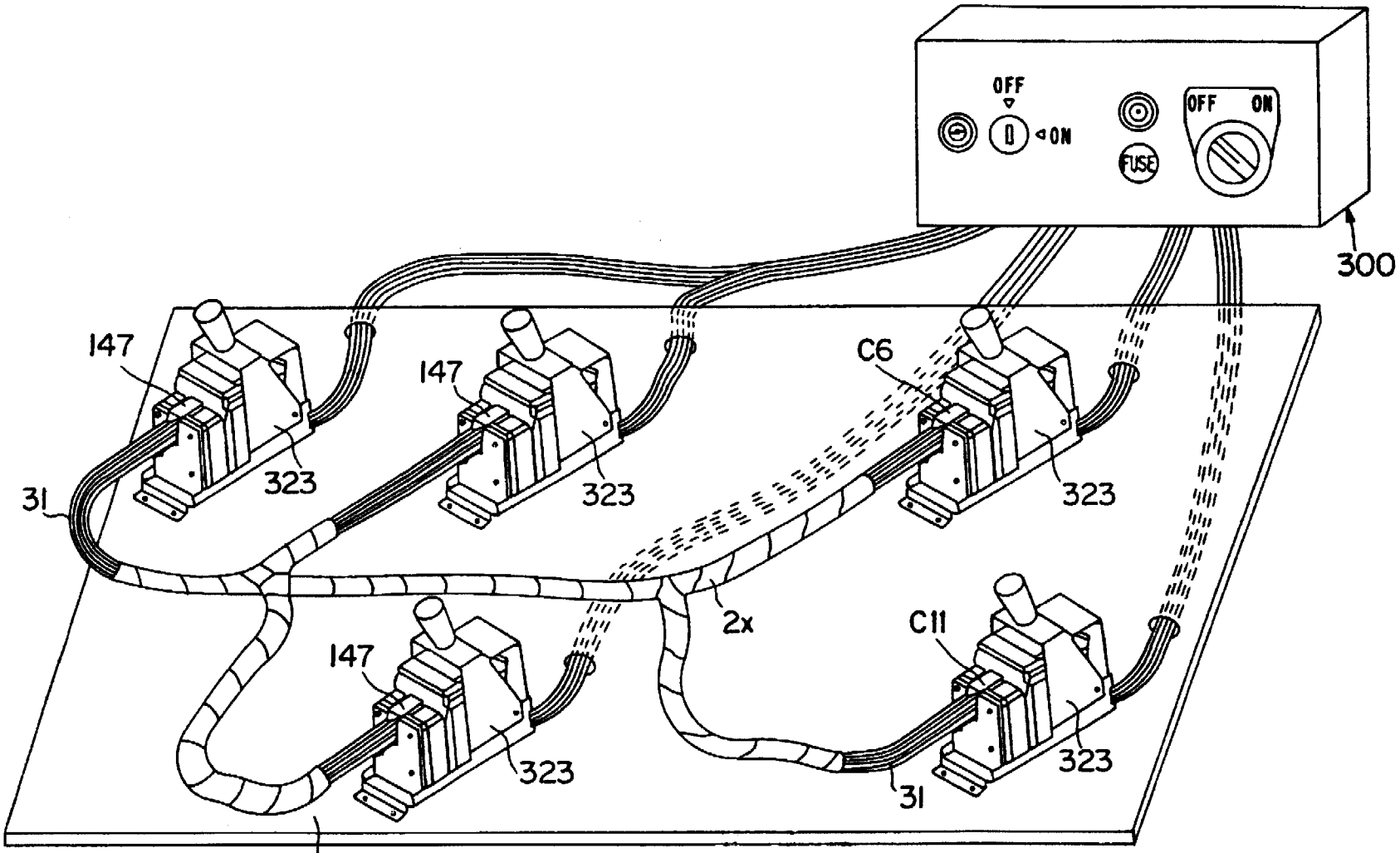
FIG. 7 is a perspective view of an assembly board for continuity testing.

With reference to FIGS. 4 and 5, holding jig 147 temporarily holds terminal 31A; terminal 31A is a female terminal, to be connected to a male terminal (not shown) and is integrally equipped with tip T1. Barrel T2 is crimped on the end of cable 31. Between tip T1 and barrel T2, there is a pair of stabilizers T3; terminal 31A is also provided with lance holes T4 as stops. Terminal 31A constitutes a last-in terminal to be inserted into the connector housing by the last-in process. The last-in process means a process for binding a plurality of temporary binding circuits 1x and 2x. However, in the present Invention, the last-in process includes a wide range of processes for connecting wire harnesses to equipment (for instance, automobiles).

Holding jig 147 comprises main body 147A of generally rectangular plate form. Main body 147A is preferably resin molded with an integral pair of side walls 147B and a plurality of partitions 147C parallel to side wall 147B and spaced apart from each other. Between side walls 147B and the adjacent partitions 147C, as well as between adjacent partitions 147C, terminal receiving chambers 147E accommodate terminals 31A.

Cross pieces 147F extend parallel to the plane of main body 147A and are desirably integral therewith. Each receiving chamber 147E is in channel form with a U-shaped cross section. The upper edge (as shown in FIGS. 4 and 5) of each chamber 147E comprises a terminal entry 147G for insertion of terminal 31A lead by tip T1. The lower edge (as seen in FIGS. 4 and 5) comprises terminal exit 147H to allow terminals 31A to be removed therethrough. Thus, entry 147G and exit 147H allow terminals 31A to enter and leave receiving chamber 147E by movement thereof in one direction. Each of cross pieces 147F is spaced apart from its adjacent cross piece 147F by gap 147L. Gap 147L constitutes an opening through which cable 31 may pass both inwardly and outwardly.

Receiving chambers 147E are provided with ribs 147J extending from entry 147G to exit 147H and are advantageously integrally formed with chambers 147E. Each rib 147J comprises inclined surface J1, which guides terminal 31A as it is introduced into chamber 147E through entry 147G in a terminal entering direction (arrow A1 in FIGS. 4 and 5). Thereafter, ramp J2, which rises smoothly away from body 147A, guides terminals 31A so that edge J3 is resiliently lifted away from main body 147A. Contiguous to ramp J2 is stop J4, which is adapted to enter lance hole T4 when terminal 31A is fully in chamber 147E. Thus, rib 147J and stop J4 cooperate to allow terminal 31A to be temporarily held in receiving chamber 147E and to release terminal 31A when terminal 31A is urged in terminal entering direction A1.

With reference to FIG. 5, when Tip T1 of terminal 31A enters entry 147G and moves into receiving chamber 147E along ramp J2, stop J4 is displaced toward main body 147A as a result of resilient deflection of edge J3, thereby allowing terminal 31A to enter. When stop J4 is opposite lance hole T4, it enters hole T4 and terminal 31A is firmly held between side walls 147B, partitions 147C, main body 147A, and cross pieces 147F, by the elasticity of edge J3.

The back side of guide J41, which guides the lower surface of tip T1, is smoothly connected to ramp J2 and shoulder J42, as shown in FIG. 2. As terminal 31A moves in direction A1, after being temporarily held, the back face of guide J41 is displaced by the rim of lance hole T4, thereby releasing stop J4. However, if terminal 31A is pulled towards entry 147G, shoulder J42 bears against lance hole T4 and prevents movement of terminal 31A. Therefore, terminal 31A will not release in this direction. Moreover, if it is attempted to introduce 31A from exit 147H, shoulder J42 of stop member J4 contacts terminal 31A and prevents entry. Therefore, if an operator tries to manually insert terminal 31A into holding jig 147 from the wrong direction, stop J4 will prevent the error.

In a further refinement of the Invention, as shown in FIG. 4, a pair of entry slots 147M, which receive stabilizers T3, is provided. Cross pieces 147F define depth D of slot 147M so that terminal 31A can enter receiving chamber 147E only when stabilizers T3 are properly positioned. Thus, the insertion position of terminal 31A is uniformly defined, and mistakes by the operator are prevented.

With reference to FIGS. 4 and 5, main body 147A, side walls 147B, and partitions 147C are provided with the same dimension in the lengthwise direction A1 of terminal chambers 147E, and lower ends 147K are in the same plane as tips T1 of terminals 31A.

By mounting terminals 31A in temporary holding jig 147, each of temporary binding circuits 1x and 2x is formed by a terminal insertion process which is automatic, manual, or a combination thereof. Thereafter, the continuity test is performed on temporary binding circuits 1x and 2x after the completion of the terminal insertion process.

On assembly board 220, a plurality of testers 323, which correspond to connectors C6, C11, temporary holding jig 147, etc. of binding circuit 2x are arranged. The testing device detects the continuity of each terminal 31A connected to corresponding connectors C6, C11, and holding jig 147 and, if the continuity is acceptable, outputs an appropriate signal to controller 300.

The exterior of holding jig 147 conforms to testing devices 323, so that terminals 31A are complementary to the their corresponding connectors (in the present case, joint connectors 600 of binding circuit 1x). Therefore, the connections of terminals 31A can be predetermined and the continuity test, even for binding circuit 2x, can be readily carried out. Binding circuits 1x and 2x which have passed the continuity test are bound and completed as wire harness WH. Thereafter, holding jig 147, which temporarily holds terminals 31A, is transferred to corresponding connectors C1 or C2.

Thus, each terminal 31A which is held by temporary holding jig 147 is electrically connected to joint connector 600 which is fixed in the final binding process; therefore, both temporary binding circuits 1x and 2x unite to form wire harness WH (FIG. 1).

Figure 8:
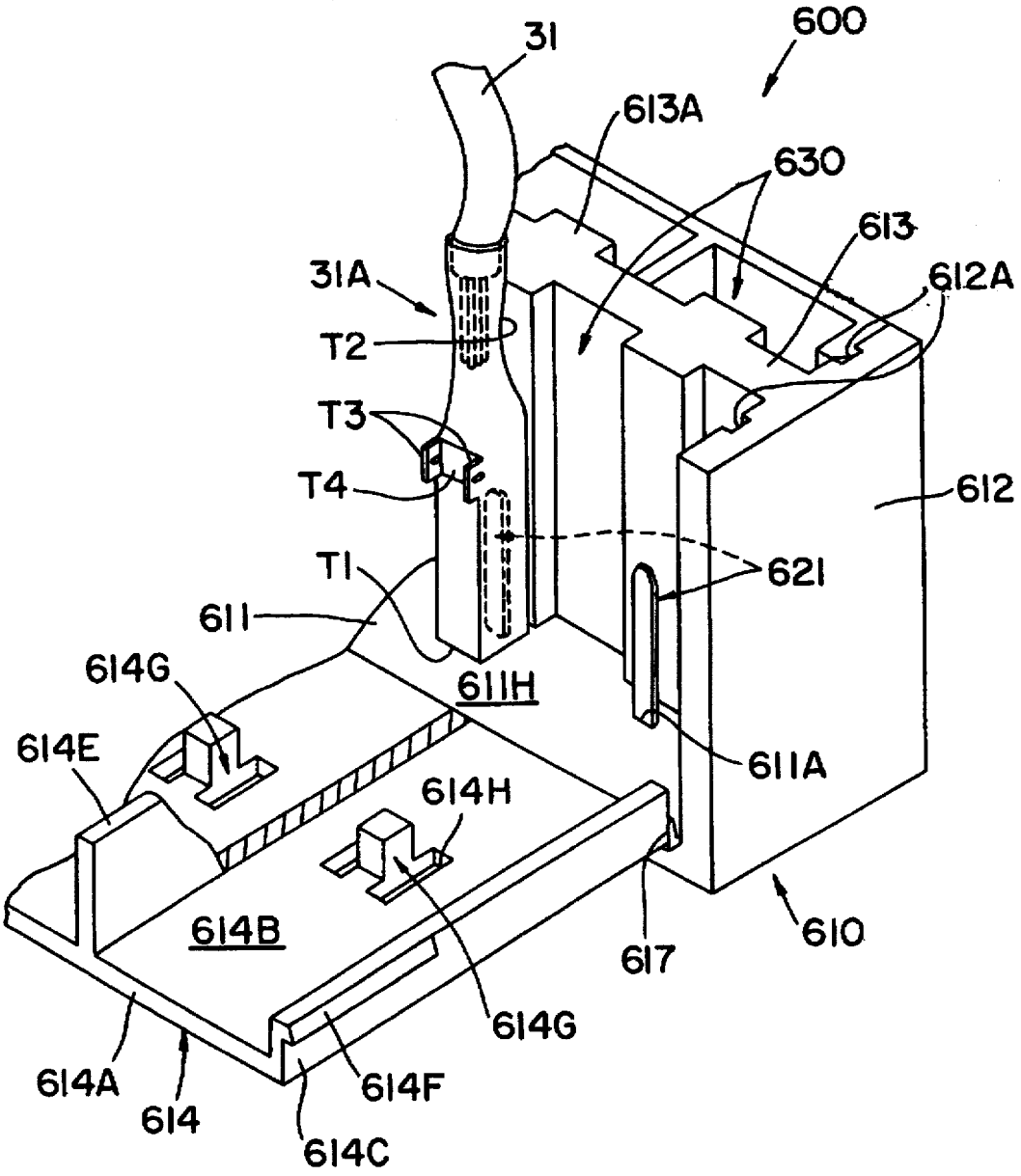
FIG. 8 is a fragmentary perspective view of a principal portion of the joint connector of the present Invention.
Figure 9:
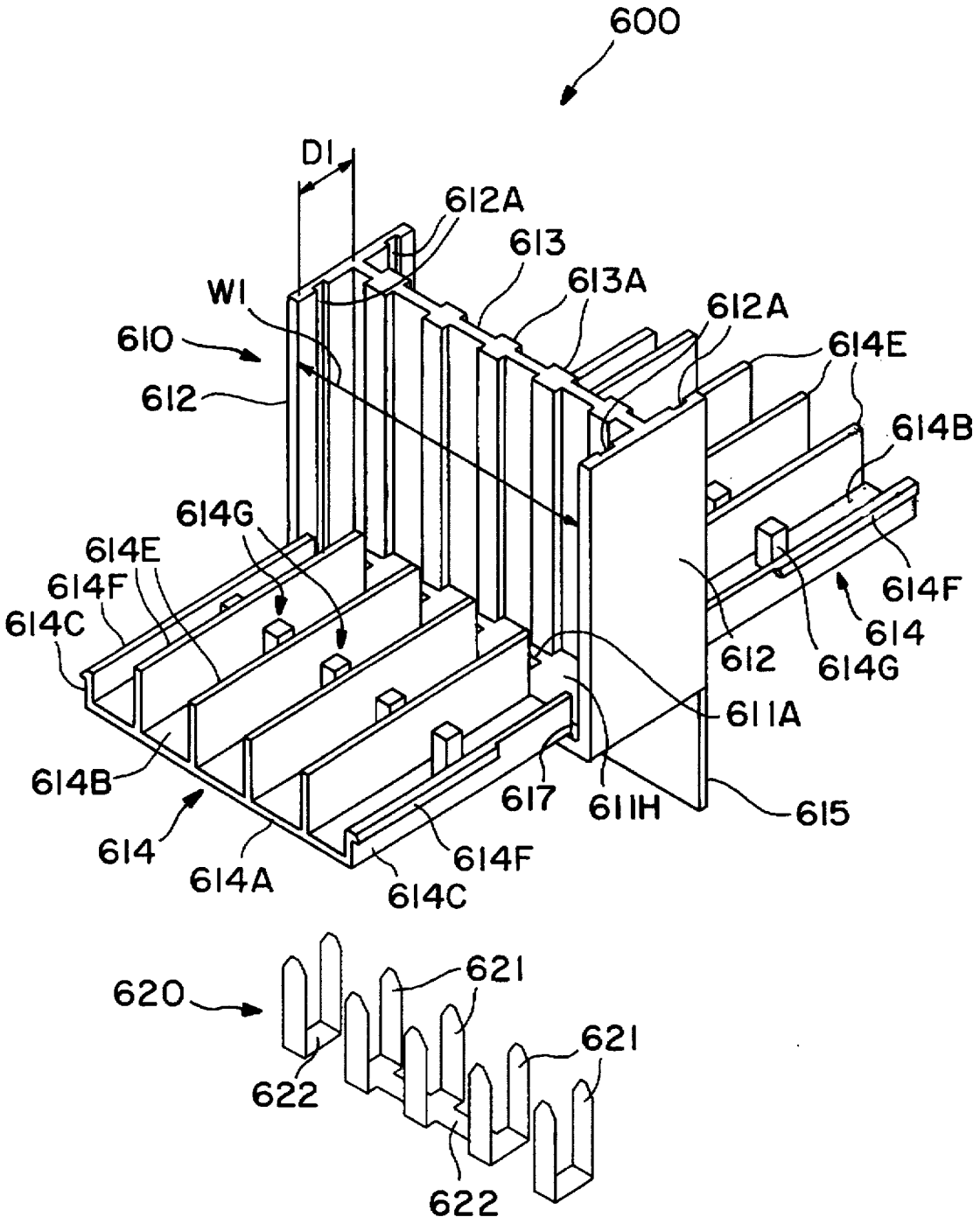
FIG. 9 is an exploded perspective view of the joint connector of FIG. 8.
Figure 10:
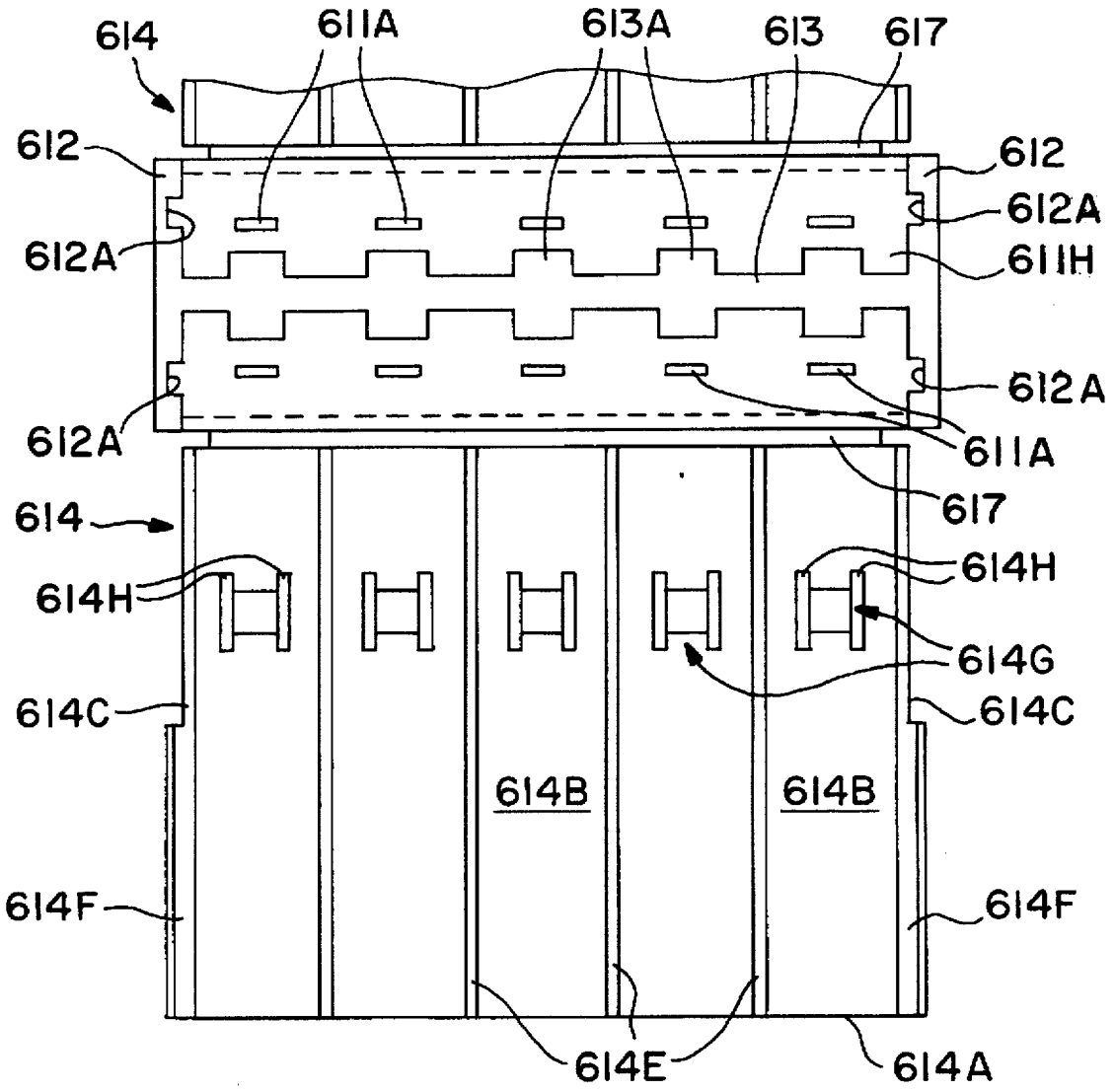
FIG. 10 is a fragmentary plan view of the joint connector of FIG. 8.

Referring to FIGS. 8–10, joint connector 600 comprises main housing 610 which is divided into a plurality of terminal chambers 630. Each terminal chamber receives terminal 31A which is fixed to an end of cable 31. Clip 620 forms a branch circuit when connected to specified terminals 31A.

As shown in FIG. 9, clip 620 comprises a conductive member (made for example, of copper) having connecting area 622 between the various contacts 621 in a predetermined configuration. By selecting the shape of connecting area 622 and contacts 621, various kinds of branching circuits can be created (2 and 6 pole contacts 621 are illustrated in FIG. 9).

Main housing 610 is a molded resin part having integral bottom plate 611, substantially rectangular in plan; a pair of side plates 612 on both sides of bottom plate 611; and face 613, which is also substantially rectangular in plan, integral with bottom plate 611 and side plates 612. Bottom plate 611 is divided into two parts widthwise and further comprises a pair of covers 614. Thus, many terminal chambers 630 are partitioned so as to be adapted to receive individual terminals 31A affixed to a plurality of cables 31.

Face 613 is connected to a plurality of columns 613A spaced apart by a predetermined distance lengthwise of the bottom plate 611. Columns 613A are substantially rectangular in plan, and face 613 passes through columns 613A near the center thereof. Inner width W1 and connector depth D1 correspond to outer width dimension W2 and outer depth D2 (see FIG. 4) of main body 147A of temporary holding jig 147, and columns 613A are adapted to slidably enter and withdraw from receiving chambers 147E.

With reference to FIG. 10, in bottom plate 611, through-hole 611A is formed in register with columns 613A. By inserting contacts 621 into through-hole 611A, clip 620 can be connected to main housing 610.

Figure 11:
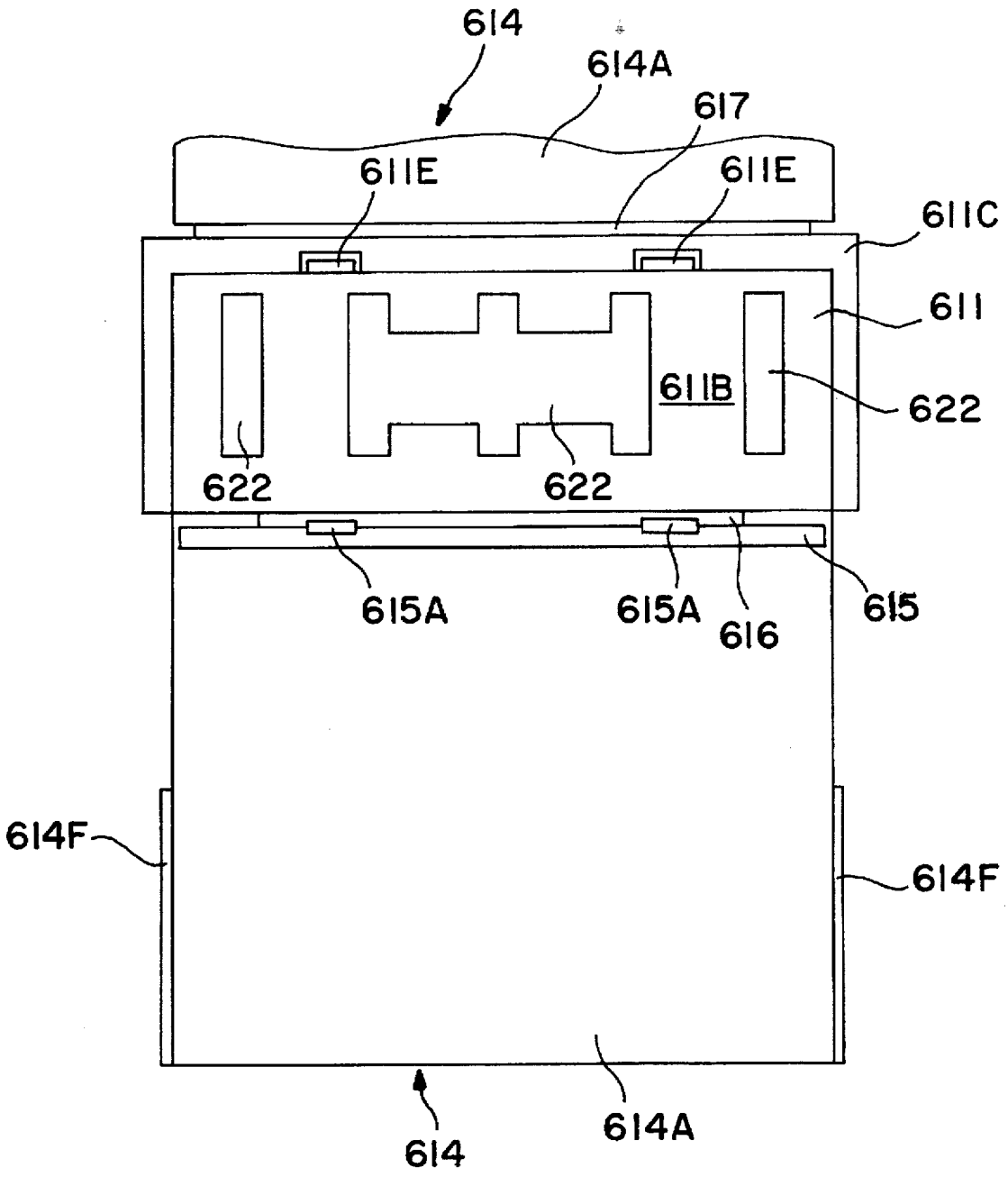
FIG. 11 is a fragmentary bottom view of the joint connector of FIG. 8.

Referring to FIGS. 9 and 11, bottom cover 615 is pivoted at bottom hinge 616 to bottom 617. By exposing bottom cover 615, bottom surface 611B of bottom plate 611 is revealed and contacts 621 can be mounted thereon from this side thereof. Bottom surface 611B of bottom plate 611 is provided with rib 611C of rectangular cross section, and a pair of detents 611E is at a predetermined position on rib 611C.

On bottom cover 615, latch 615A, which corresponds to the detent 611E, is provided. Therefore, after mounting clip 620, latch 615A engages detent 611E when bottom cover 615 is closed; thus, clip 620 is held between bottom plate 611 and bottom cover 615 so that contact 621 protrudes upward from bottom plate 611. In consequence, it is possible to insert terminal 31A into terminal chamber 630 to electrically connect with contact 621 as shown in FIG. 8.

As shown in FIGS. 8 to 10, covers 614 are equipped with cover plate 614A formed in a rectangular shape. Cover plate 614A is hinged on a length-wise side of bottom plate 611, so that it can be in an open or shut position. Cover plate area 614A is divided into a plurality of terminal chambers 630. Side walls 614C and partitions 614E are preferably integral with face 613.

Figure 18:
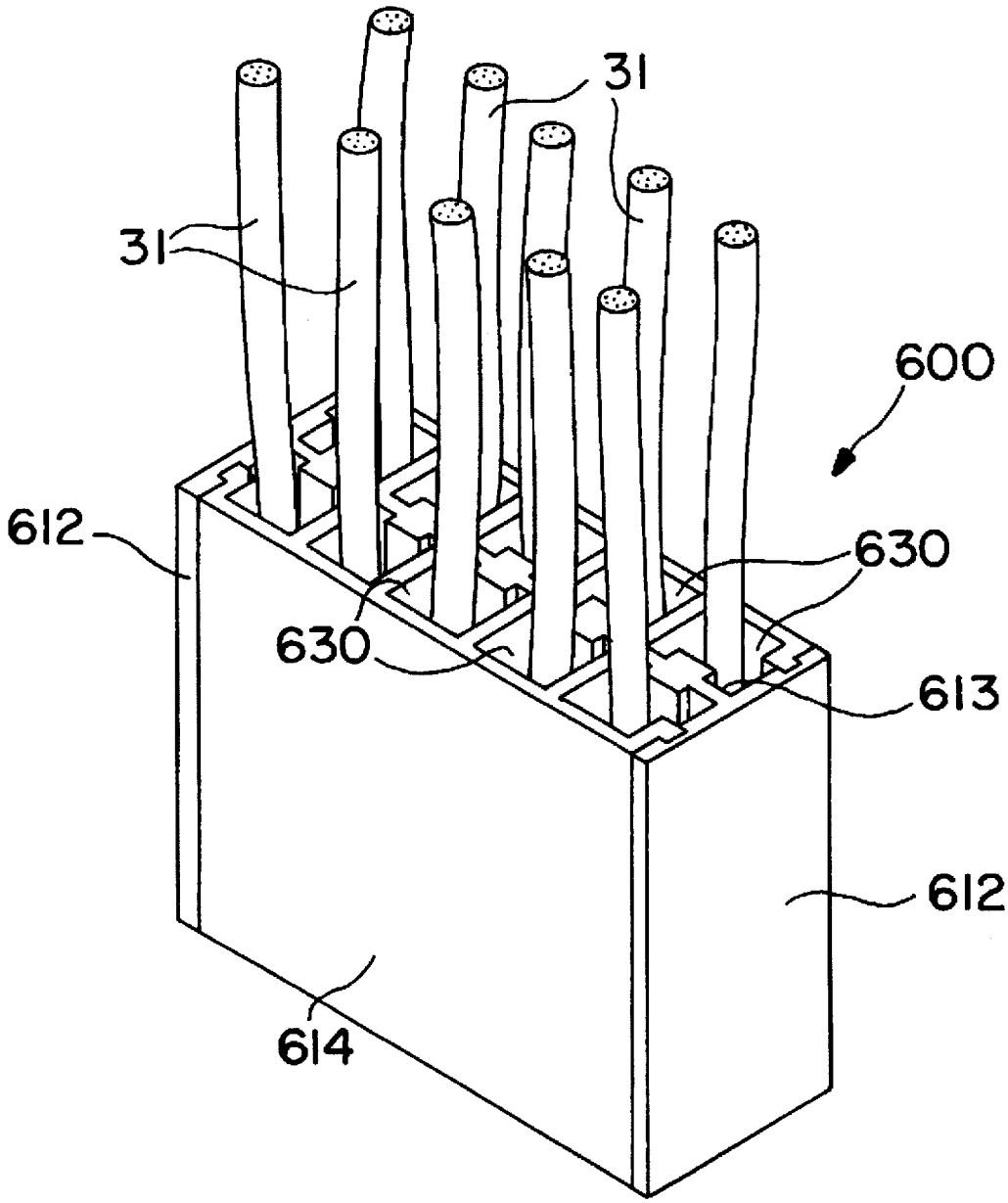
FIG. 18 is a perspective view of the joint connector of FIG. 8 with all terminals attached.
Figure 19:
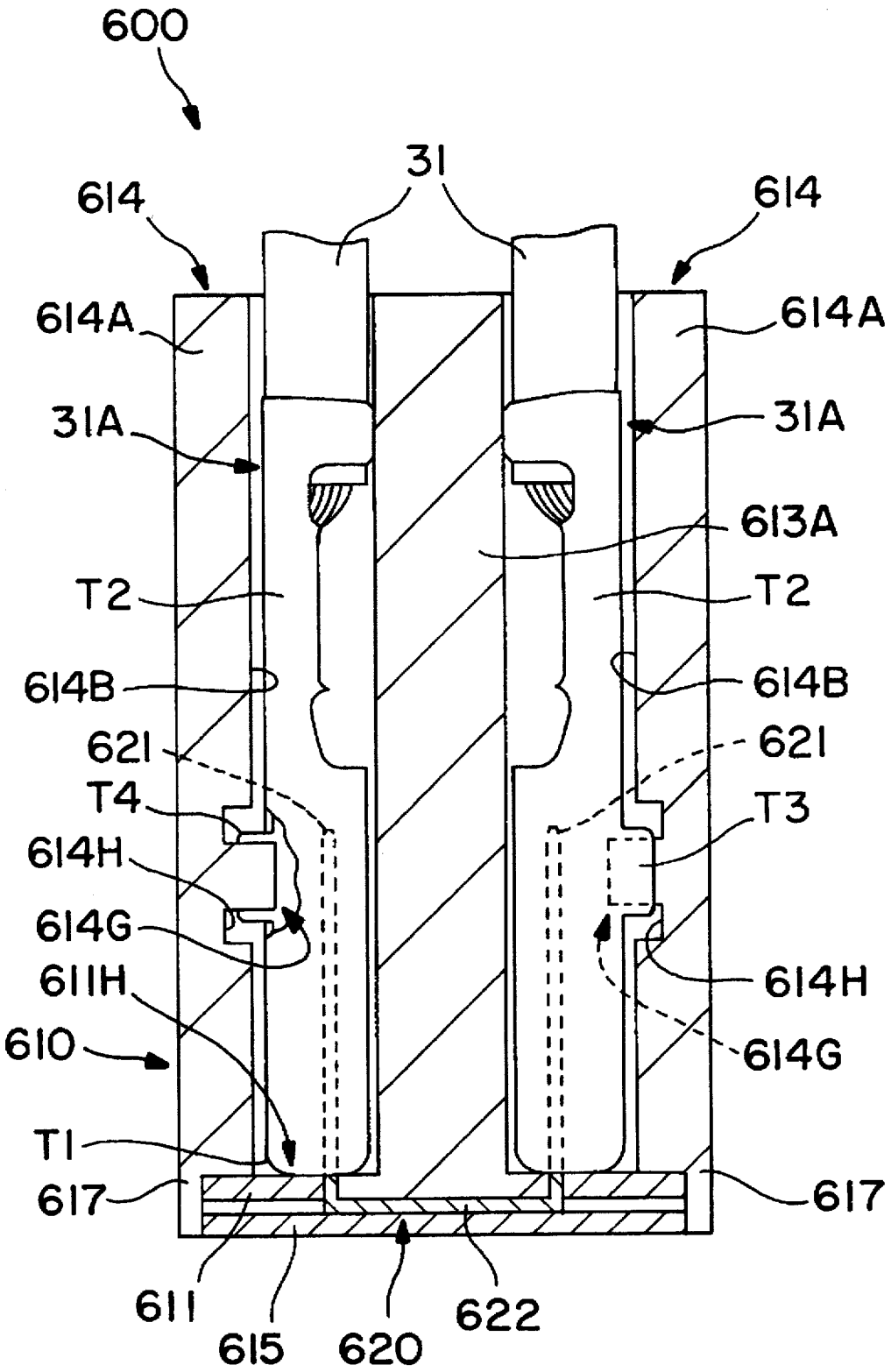
FIG. 19 is a sectional view of the joint connector of FIG. 18.

At the outside of side plates 614C, side ribs 614F for latching are integrally formed. On the inside of side plates 612, locking slots 612A, which are complementary to side ribs 614F are formed. By closing retaining covers 614 after inserting terminals 31A, side ribs 614F engage locking slots 612A whereby retaining covers 614 are held in closed position as shown in FIG. 18.

In a preferred form of the device, a plurality of protrusions 614G is provided on sectioned area 614B. There is one protrusion 614G corresponding to each terminal chamber 630. Connecting areas 622 of clip 620 are inserted through through-holes 611A to project through upper surface 611H into terminal chambers 630. After terminals 31A have been inserted through jig 147, the latter is removed and cover plate 614A is closed. This causes protrusions 614G to press firmly against terminals 31A and maintain them in good electrical contact with contacts 621. In a preferred form of the Invention, slots 614H are provided on either side of protrusions 614G to receive stabilizers T3. This acts as a locking device to securely hold terminals 31A in chamber 630.

Figure 12:
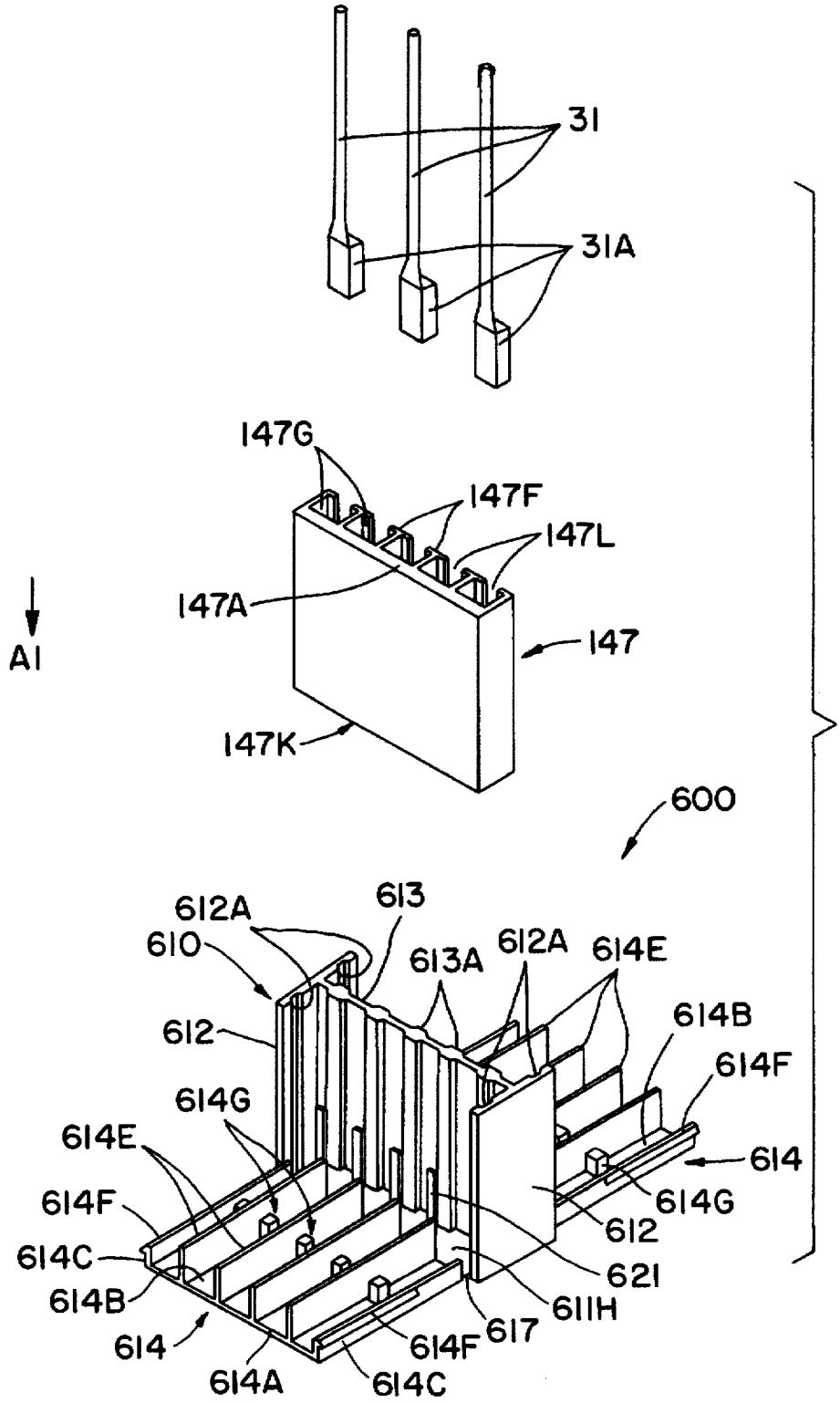
FIG. 12 is a perspective view showing the first step of a last-in process.

FIGS. 12–14, 16, and 17 illustrate the simplified last-in process of the present Invention. As can be seen in FIG. 12, terminals 31A, attached to cables 31, are introduced into holding jig 147. Each receiving chamber 147E contains stop J4 (see FIGS. 4 and 5) which serves to affirmatively position each terminal 31A therein. Holding jig 147 is placed adjacent face 613A of joint connector 600. When this is done, each receiving chamber 147E is in alignment with its corresponding terminal chamber 630.

Figure 13:
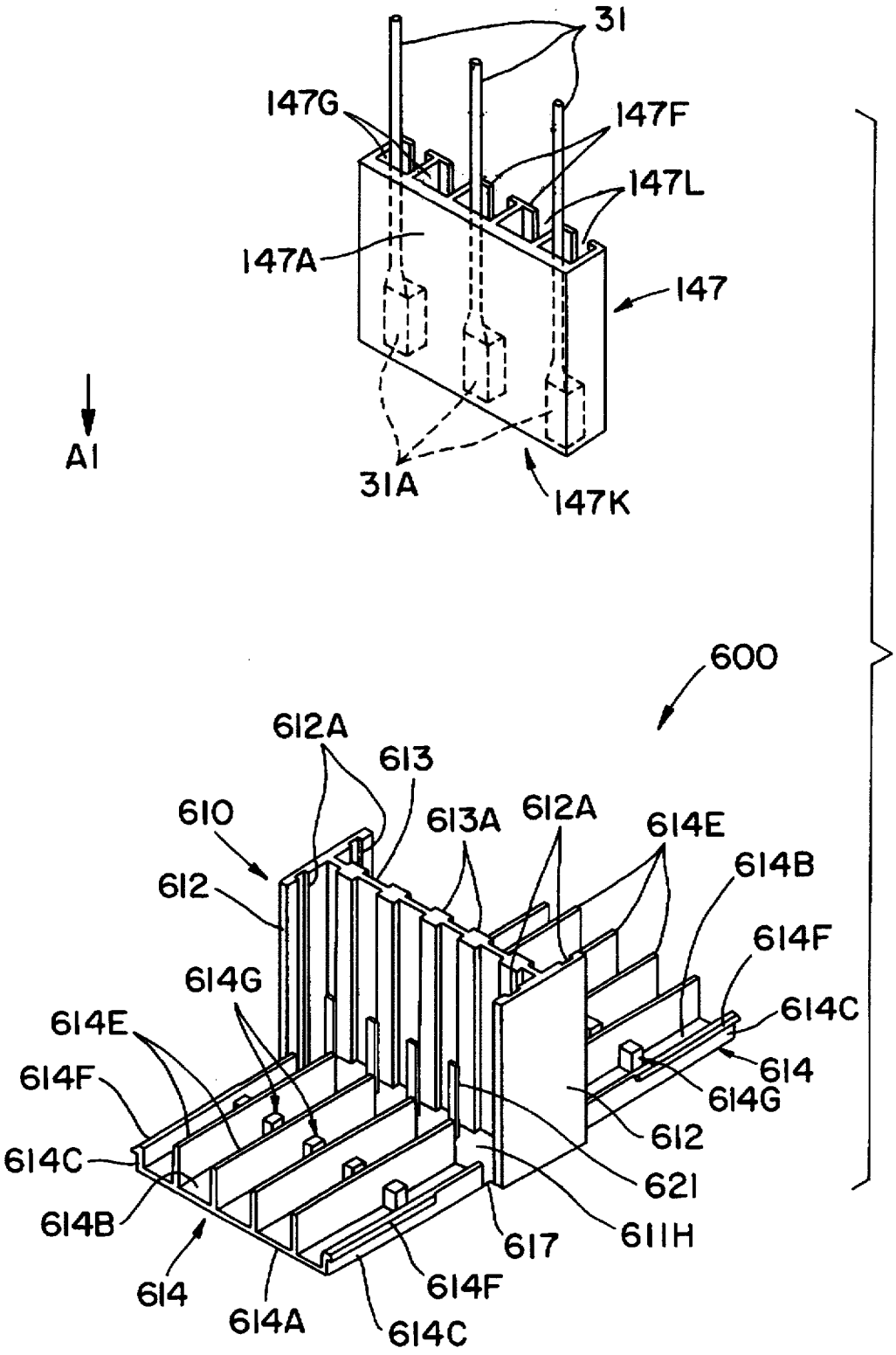
FIG. 13 is a perspective view showing a further step of the last-in process.
Figure 14:
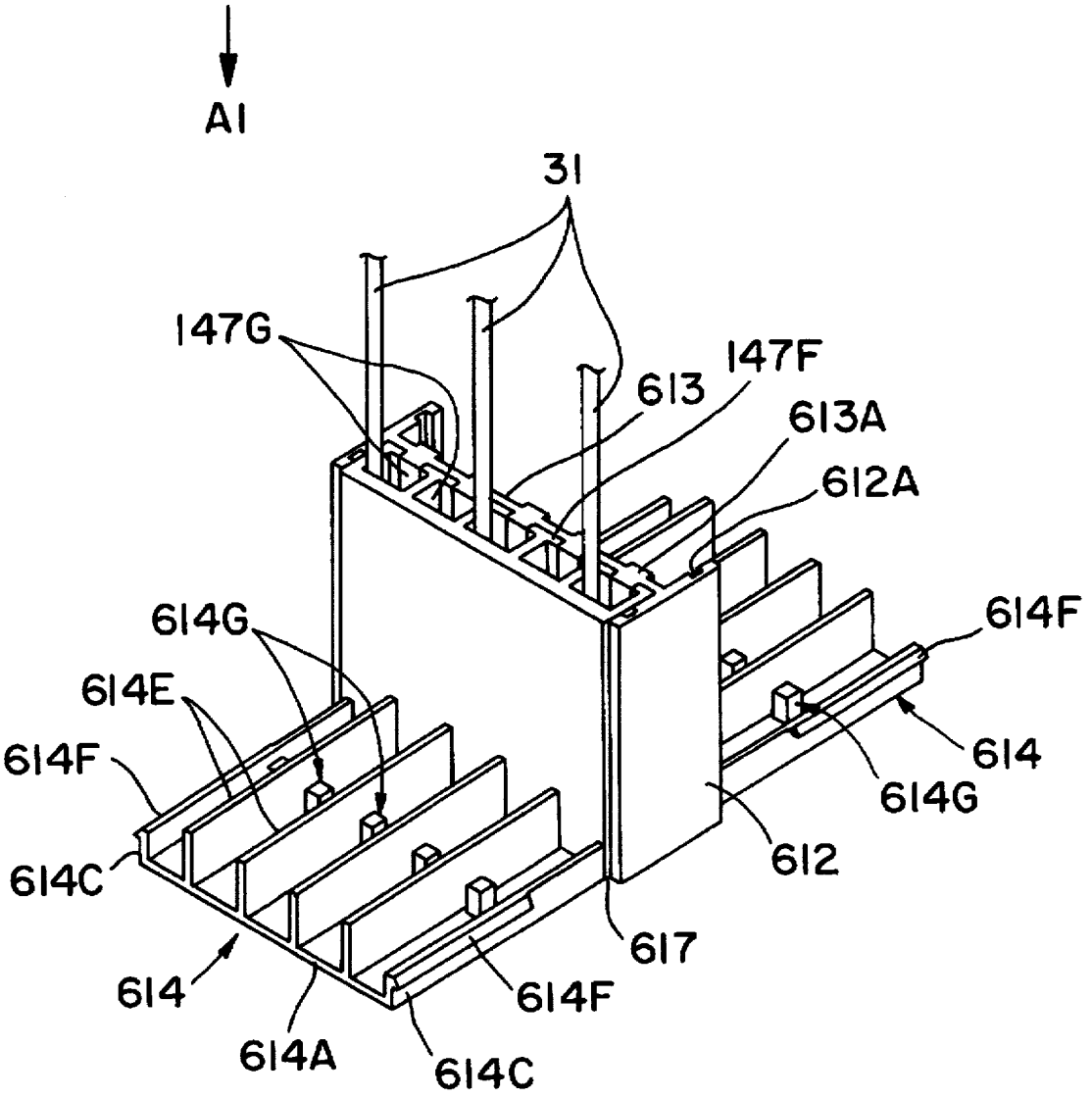
FIG. 14 is a perspective view showing a still further step of the last-in process.
Figure 15:
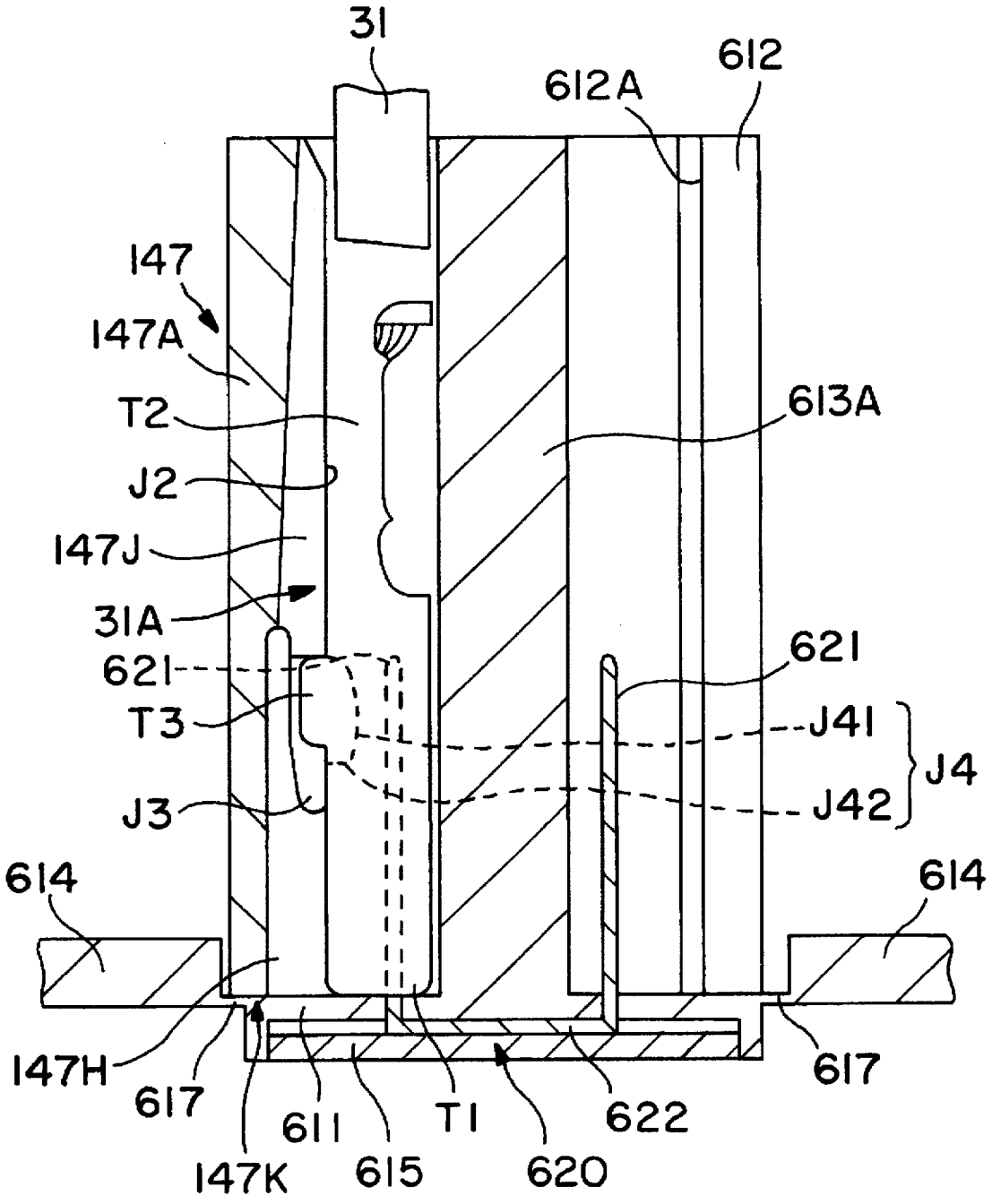
FIG. 15 is a fragmentary section of the temporary holding jig and joint connector as shown in FIG. 14.

Cover plates 614A are pivoted about cover hinges 617 so that they assume the position shown in (for example) FIG. 13. The outside dimensions D2 and W2 of jig 147 (FIG. 4) are slightly smaller than dimensions D1 and W1 (FIG. 9) of joint connector 600. Therefore, jig 147, containing terminals 31A is slidably inserted into joint connector 600 until lower end 147K abuts upper surface 611K of bottom plate 611. Contacts 621 of clip 620, which create the necessary connections to form the desired branch circuits, have previously been inserted into terminal chambers 630. Holding jig 147 is withdrawn from joint connector 600, leaving terminals 31A behind. To complete the process, cover plates 614A are closed (as shown in FIG. 18) and stabilizers T3 enter stabilizer slots 614H. In carrying out the foregoing method, gaps 147L between cross pieces 147F of holding jig 147 receive columns 613A which then act as guides to assist in the insertion of jig 147 into joint connector 600.

With the structure and method of the present Invention, since each terminals 31A is directed to its corresponding terminal chamber 630 of joint connector 600, the connections of terminals 31A can be specified, and the continuity test of temporary binding circuits (such as 1x and 2x) can be readily and reliably carried out. Therefore, testing the continuity of every temporary binding circuit and confirming product failures at an early stage of the manufacturing process can be accomplished. In addition, accommodating terminals 31A as part of temporary binding circuits 1x and 2x in temporary holding jig 147 before the final binding, prevents deformation during transportation and tangling during manufacture.

Moreover, it becomes possible to reliably connect each terminal 31A to its joint connector 600 because each terminal 31A is aligned in the desired connecting arrangement. Therefore, erroneous connections can be positively avoided. Further, because terminals 31A which were temporarily held in jig 147 are directly transferred to joint connector 600 and connected to clip 620, it is possible to eliminate the use of a female housing to be connected therewith, thereby reducing the number of parts and the cost.

The Invention provides a reliable connecting process with improved workability, even when temporary holding jig 147 is connected to joint connector 600 by hand. This is because terminals 31A, temporarily held in holding jig 147, are directed to contacts 621 of clip 620 by guiding main body 147A by means of side plates 612, faces 613, and columns 614 of main housing 610 of joint connector 600.

Figure 16:
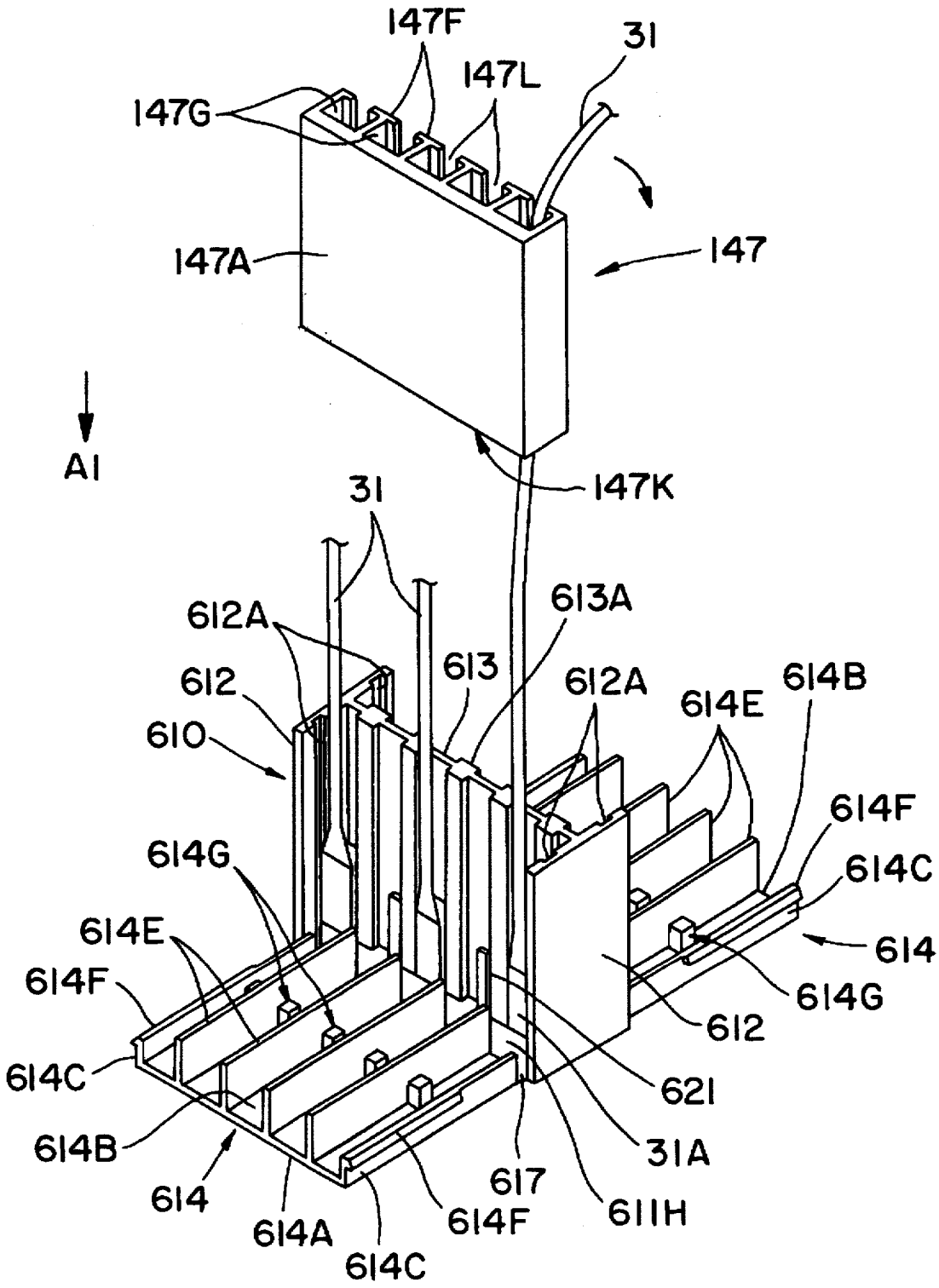
FIG. 16 is a perspective view showing a modification of the last-in process.
Figure 17:
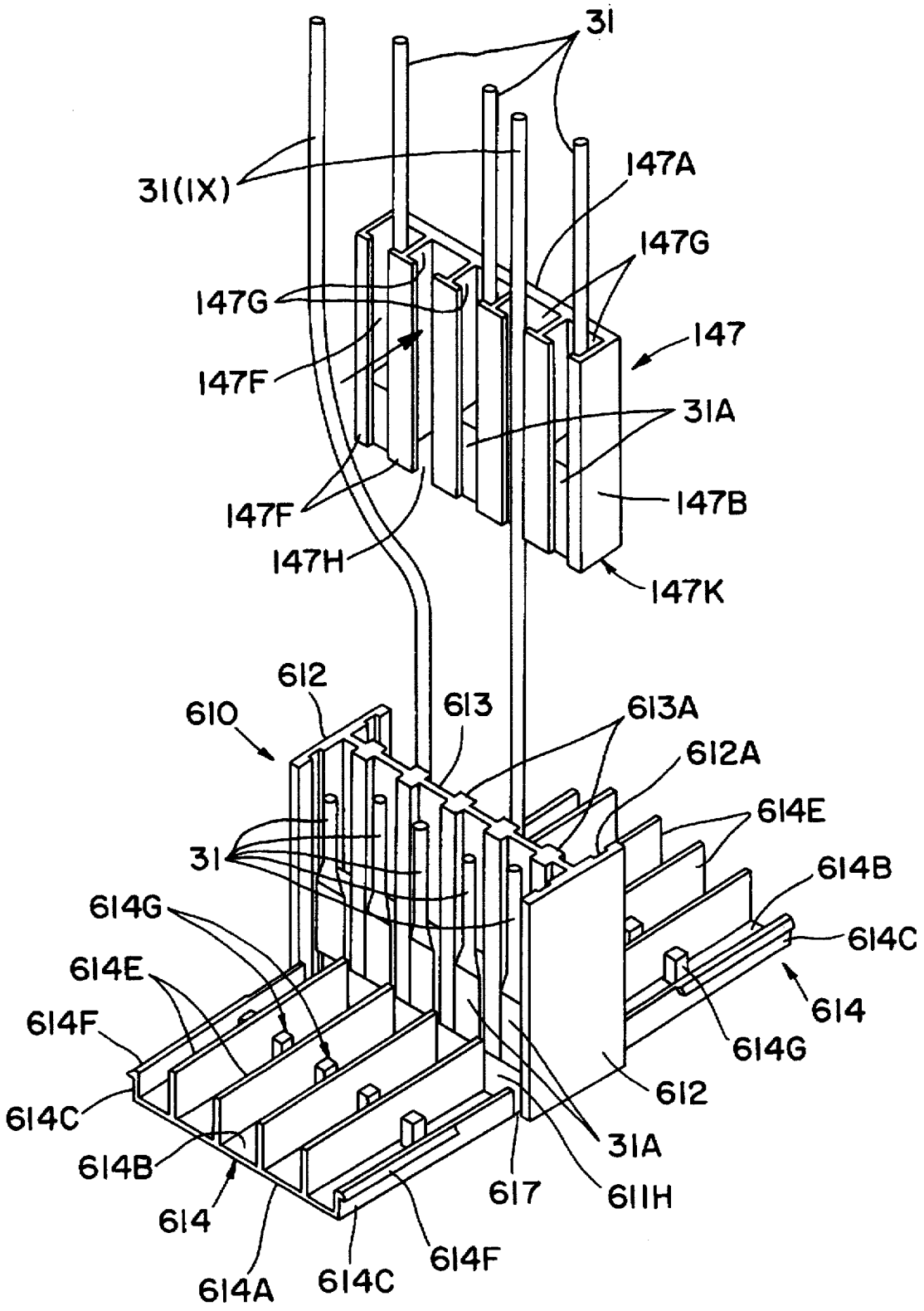
FIG. 17 is an enlarged perspective view of FIG. 16.

FIGS. 16 and 17 illustrate a modification of the inventive device and process. Although holding jig 147 has not yet been inserted into joint connector 600, cables 31 and terminals 31A from binding circuit 1x have already been positioned in their respective terminal chambers 630. Therefore, in those receiving chambers 147E corresponding thereto, no terminals 31A are present. Since it is necessary that cables 31 corresponding to the inserted terminals 31A be introduced into holding jig 147, gaps 147L are provided. They are wide enough to permit cables 31 to pass therethrough. Thus, when binding circuits 1x and 2x are to be joined together in joint connector 600, these cables are inserted into receiving chambers 147E through gaps 147L. When holding jig 147 is to be separated from terminals 31A and cables 31, the latter are removed through the same gaps 147L. This permits the operator to insert and remove the cables as desired without one interfering with the other.

Figure 20:
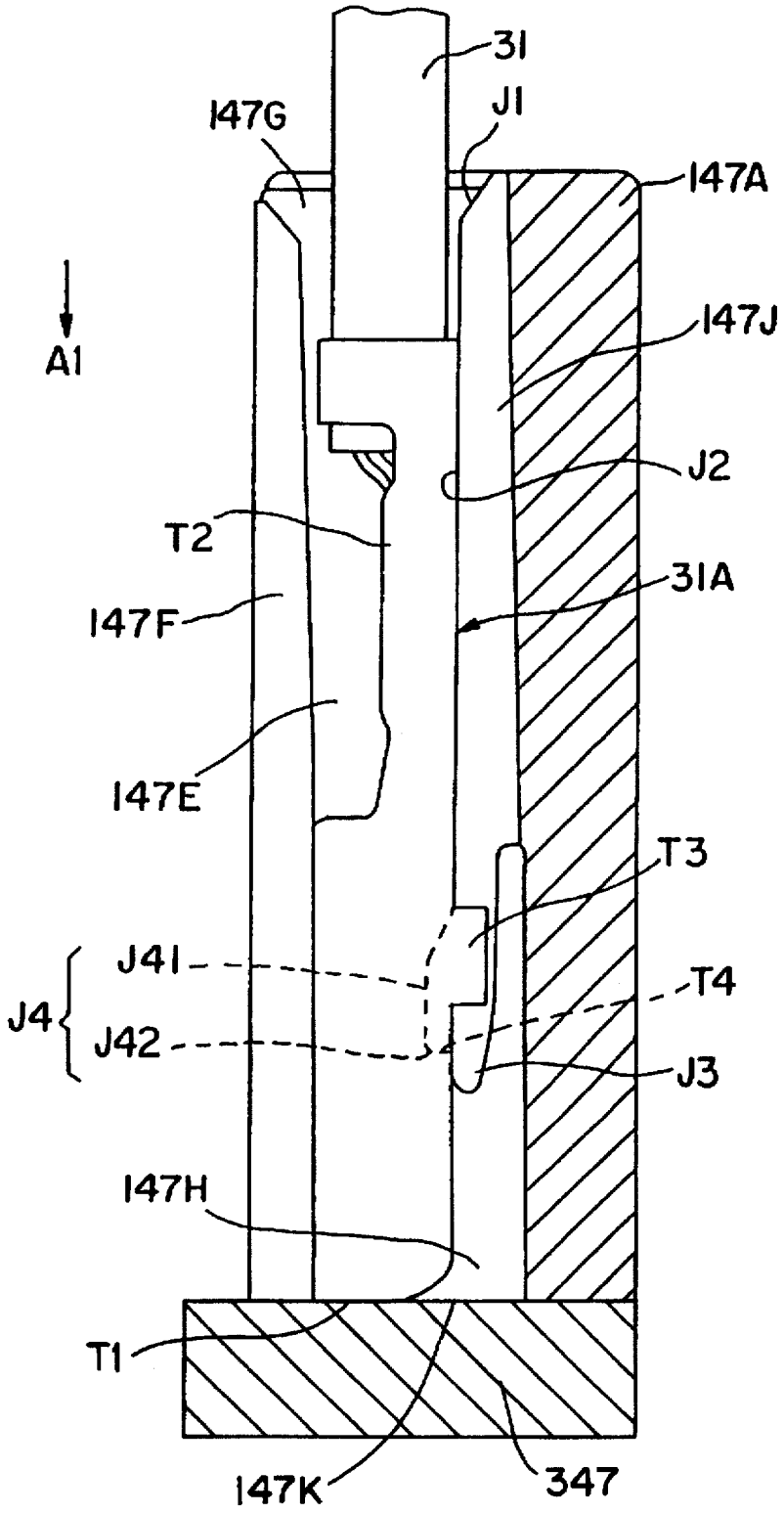
FIG. 20 is a vertical section of a modification of the temporary holding jig of FIG. 4.

While only a limited number of embodiments of the present Invention have been expressly disclosed, such modifications as would suggest themselves to those having ordinary skill in the art may be made without departing from the purview thereof. For example, when holding terminals 31A are in the temporary holding jig as shown in FIG. 20, stop member 347 may be adopted; this member does not invade receiving chamber 147E, but positions terminals 31A with respect to main body 147A and holds terminals 31A to temporary holding jig 147 more positively.

Figure 21:
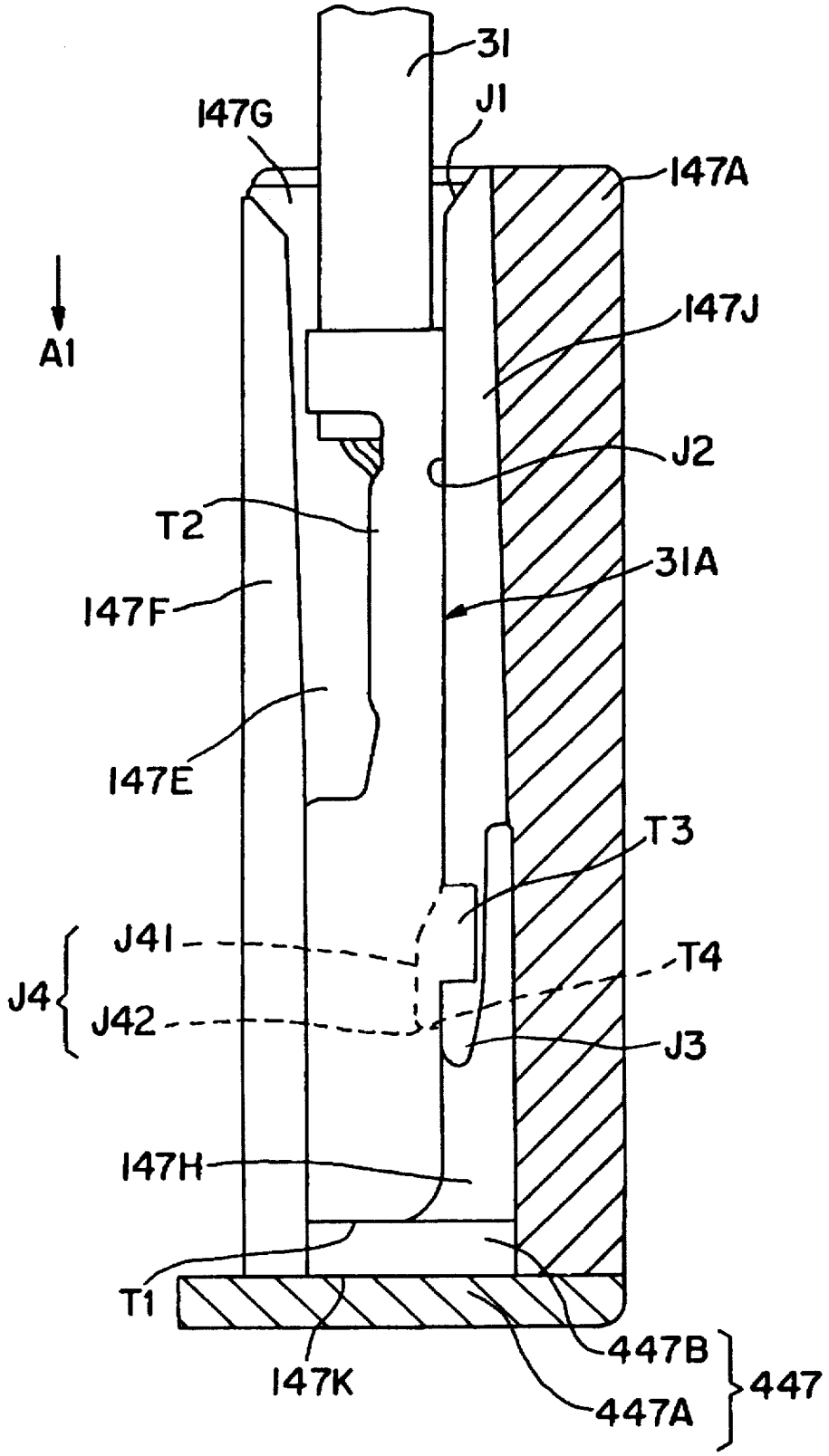
FIG. 21 is a vertical section of a further modification of the temporary holding jig of FIG. 4.

Alternatively, as shown in FIG. 21, terminals 31A can be located at a position such that tips T1 are within receiving chamber 147E. In this case, stop member 447 is provided with base 447A at lower end 147K; Protuberance 447B protrudes into receiving chamber 147E. Tips T1 rest thereon to positively fix terminals 31A within jig 147.

Figure 22:
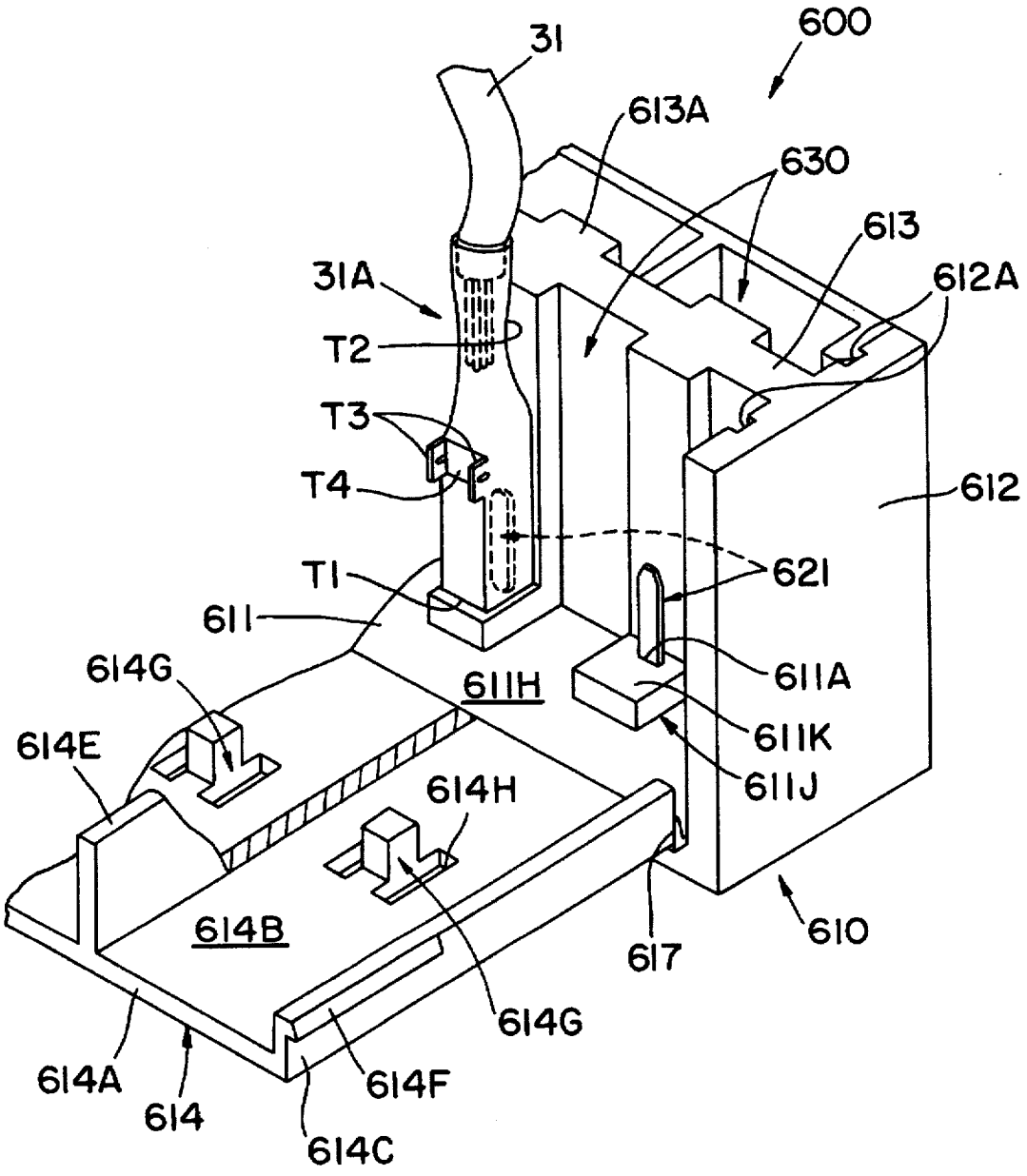
FIG. 22 is an enlarged fragmentary perspective of the principal portion of the joint connector of FIG. 21.

Referring to FIG. 22, joint connector 600, for use with holding jig 147 as shown in FIG. 21, is provided with seat 611J on upper surface 611H of bottom plate 611. When terminals 31A are introduced into terminal chambers 630 through exit 147H, tips T1 contact upper surface 611K of seat 611J, thereby affirmatively locating the terminals therein.

Although it is preferable to provide cover plates 614A which open and close, this is not essential to the present Invention. For example, protrusions 614G can be made integral with a stop member comprising main housing 610 and an additional element. The stop member could be molded after terminals 31A have been placed within receiving chambers 147E. However, since protrusion 614G and main housing 610 can be made integral (as shown in FIG. 8), it is easy to handle and is considered a preferred form of the Invention.

These and other changes may be made in the present Invention while still remaining within the scope and spirit thereof. It is not to be limited except by the character of the claims appended hereto.

What we claim is:

1. A joint connector for holding and electrically connecting a plurality of terminals comprising a housing containing a plurality of terminal chambers parallel to and adjacent one another, thereby forming a row of said terminal chambers, each of said terminal chambers adapted to receive one of said terminals each of said terminals being introduced in a insertion direction, at least one cover plate hingedly mounted on said housing and constituting a side thereof, said cover plate being rotatable between an open position, wherein said cover plate is away from said housing thereby exposing said terminal chambers, and a closed position, wherein said cover plate is adjacent said housing and said terminal chambers are enclosed, at least one electrically conductive clip having at least two contacts which are electrically connected to each other by an intermediate area, each of said contacts extending into one of said terminal chambers, whereby two said terminals, in said terminal chambers, make electrical connections with said contacts.

2. The joint connector of claim 1 wherein there is a plurality of protrusions on an inner face of said cover plate, each adapted to press against one of said terminals when said cover plate is in said closed position.

3. The joint connector of claim 1 wherein said housing is adapted to receive, when said cover plate is in said open position, a holding jig which temporarily contains said plurality of said terminals, said holding jig adapted to be thereafter withdrawn from said housing, leaving said terminals behind.

4. The joint connector of claim 1 wherein at least one side rib is on said cover plate and a corresponding locking slot is on said housing whereby, when said cover plate is in said closed position, said side rib is in said locking slot and said cover plate is secured thereby in said closed position.

5. The joint connector of claim 1 wherein said terminal chambers are provided with a bottom plate having holes therethrough, said contacts projecting through said holes and said intermediate area adjacent a bottom surface of said bottom plate, a bottom cover connected to said housing by a bottom hinge adjacent said bottom plate and rotatable between a distant position, away from said bottom plate wherein said intermediate area is exposed, and a pivoted position, wherein said intermediate area is covered.

6. The joint connector of claim 1 wherein there are two said rows, parallel to each other with a wall therebetween.

7. The joint connector of claim 1 wherein said cover plate has a plurality of partitions thereon, whereby said housing is divided into said plurality of said terminal chambers.

8. The joint connector of claim 1 wherein each of said terminals comprises at least one stabilizer projecting in a direction perpendicular to said insertion direction, at least one longitudinal slot in said terminal chamber and corresponding to said stabilizer, whereby said stabilizer, sliding in said longitudinal slot, guides each of said terminals into said terminal chamber.

9. The joint connector of claim 3 wherein said holding jig comprises a plurality of longitudinal receiving chambers, parallel to and adjacent one another, each of said receiving chambers having a terminal entry at an upper end and a terminal exit at a lower end, each of said receiving chambers adapted to receive one of said terminals and a portion of one of said cables connected thereto, said holding jig adapted to eject said terminals by pressure thereon in said insertion direction, each of said receiving chambers corresponding to one of said terminal chambers whereby, when each of said terminals is ejected from said holding jig, it enters one of said terminal chambers.

10. The joint connector of claim 3 wherein a longitudinal gap is provided in each of said receiving chambers to permit passage of each of said cables therethrough in a direction perpendicular to said insertion direction.

11. The joint connector of claim 5 wherein there is a latch on said bottom cover at an edge remote from said bottom hinge and a corresponding detent on said housing adjacent said bottom surface.

12. The joint connector of claim 6 wherein said wall is provided with guides for insertion of said terminals.

* * * * *